US009816455B2

(12) United States Patent
Ishimatsu et al.

(10) Patent No.: US 9,816,455 B2
(45) Date of Patent: Nov. 14, 2017

(54) CONTROL SYSTEM FOR ENGINE

(71) Applicant: TOYOTA JIDOSHA KABUSHIKI KAISHA, Toyota-shi, Aichi-ken (JP)

(72) Inventors: Kenichi Ishimatsu, Toyota (JP); Hirofumi Osada, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 51 days.

(21) Appl. No.: 15/164,127

(22) Filed: May 25, 2016

(65) Prior Publication Data

US 2016/0348607 A1 Dec. 1, 2016

(30) Foreign Application Priority Data

May 27, 2015 (JP) ..... 2015-107572
Apr. 14, 2016 (JP) ..... 2016-081145

(51) Int. Cl.

*F02M 21/02* (2006.01)
*F02D 41/30* (2006.01)
*F02D 41/08* (2006.01)
*F02D 41/00* (2006.01)

(52) U.S. Cl.

CPC ..... *F02D 41/3094* (2013.01); *F02D 41/0025* (2013.01); *F02D 41/08* (2013.01); *F02D 2200/025* (2013.01); *F02D 2200/0612* (2013.01); *F02D 2250/28* (2013.01)

(58) Field of Classification Search

CPC ..... F02D 19/0642; F02D 41/3094; F02D 41/402; F02D 19/0692; F02M 51/00; F02M 69/045

USPC ..... 123/27 GE, 525, 526, 527, 429, 432

See application file for complete search history.

(56) References Cited

U.S. PATENT DOCUMENTS 5,628,294 A * 5/1997 Krieckaert ..... F02C 9/40 123/525
6,152,109 A * 11/2000 Melchior ..... F02M 47/02 123/447
6,227,177 B1 * 5/2001 Yamafuji ..... F02D 41/0042 123/399
2016/0123252 A1 * 5/2016 Yoshizaki ..... F02D 41/107 123/436
2016/0123253 A1 * 5/2016 Saito ..... F02D 41/307 123/406.23

(Continued)

FOREIGN PATENT DOCUMENTS

JP 2006-214415 A 8/2006
JP 2014-015878 A 1/2014
JP 2014-101784 A 6/2014

*Primary Examiner* — John Kwon
(74) *Attorney, Agent, or Firm* — Oliff PLC

(57) ABSTRACT

An engine is equipped with a first injection valve that injects fuel into an intake passage, and a second injection valve that injects fuel into a cylinder. The engine is provided with a fuel supply system having a first supply path for the first injection valve and a second supply path for the second injection valve. Moreover, an electronic control unit of the engine executes a unilateral injection process for causing fuel to be injected from one of the first injection valve and the second injection valve and prohibiting fuel injection from the other injection valve, when it is determined that there is a deviation between a property of fuel in the first supply path and a property of fuel in the second supply path.

12 Claims, 17 Drawing Sheets

(56) References Cited

U.S. PATENT DOCUMENTS

2016/0153373 A1* 6/2016 Yoshizaki ..... F02D 41/10
123/406.48

* cited by examiner

CONTROL SYSTEM FOR ENGINE

INCORPORATION BY REFERENCE

The disclosure of Japanese Patent Applications No. 2015-107572 and No. 2016-081145 filed on May 27, 2015 and Apr. 14, 2016 including the specifications, drawings and abstracts is incorporated herein by reference in its entirety.

BACKGROUND OF THE INVENTION

1. Field of the Invention

The invention relates to a control system that is applied to an engine that is provided with a plurality of injection valves capable of supplying fuel into the same cylinder.

2. Description of Related Art

In Japanese Patent Application Publication No. 2006-214415 (JP 2006-214415 A), there is described an exemplary engine that is provided, for each cylinder, with a first injection valve that injects fuel into an intake passage and a second injection valve that directly injects fuel into a combustion chamber. A fuel supply system of this engine is equipped with a common path that is connected to a fuel tank, a first supply path that is connected to a downstream end of the common path, and a second supply path that is connected to the downstream end of the common path. Fuel is supplied to the first injection valve through the first supply path, and fuel is supplied to the second injection valve through the second supply path. Moreover, in the case where an injection sharing ratio is a value obtained by dividing an amount of fuel injection from the first injection valve by a sum of the amount of fuel injection from the first injection valve and an amount of fuel injection from the second injection valve, a control device for the engine controls the respective injection valves by setting the injection sharing ratio to a value corresponding to an operating state of the engine.

Incidentally, the engine described in Japanese Patent Application Publication No. 2006-214415 (JP 2006-214415 A) is an engine that can be operated through the use of alcohol-containing fuel. The injection sharing ratio is changed in accordance with the concentration of alcohol in fuel.

By the way, even when the interior of the fuel tank is refueled with new fuel as fresh fuel, old fuel, that is, the fuel used prior to refueling remains in both the first supply path and the second supply path. Therefore, for a while even after refueling, even when either the first injection valve or the second injection valve is driven, old fuel is injected from the injection valve. When old fuel is thus injected from the injection valve, the amount of old fuel remaining in the supply path gradually decreases, and the interior of the supply path is soon filled with new fuel. When the interior of the supply path is thus filled with new fuel, new fuel is injected from the injection valve.

It should be noted herein that the volume of the first supply path and the volume of the second supply path are generally different from each other. Therefore, the timing when the interior of the first supply path is filled with new fuel and the timing when the interior of the second supply path is filled with new fuel are unlikely to coincide with each other. That is, although old fuel still remains in one of the first supply path and the second supply path, the interior of the other supply path is likely to be filled with new fuel. Then, for example, under the situation where old fuel still remains in the second supply path even when the interior of the first supply path is filled with new fuel, new fuel is injected from the first injection valve, whereas old fuel is injected from the second injection valve. On the contrary, under the situation where old fuel still remains in the first supply path even when the interior of the second supply path is filled with new fuel, new fuel is injected from the second injection valve, whereas old fuel is injected from the first injection valve.

SUMMARY OF THE INVENTION

At this time, if there is a great deviation between the property of old fuel and the property of new fuel, there is a great deviation between the property of fuel injected from the first injection valve and the property of fuel injected from the second injection valve. Incidentally, the aforementioned injection sharing ratio is set on the premise that the property of fuel injected from the first injection valve and the property of fuel injected from the second injection valve coincide with each other. Therefore, when the engine is in operation with fuels with different properties supplied from the separate injection valves, the combustion characteristics of an air-fuel mixture containing fuel and air in each cylinder may deteriorate.

The invention provides a control system for an engine that can restrain combustion characteristics of an air-fuel mixture in a cylinder from deteriorating as a result of a deviation between the property of fuel injected from a first injection valve and the property of fuel injected from a second injection valve.

A control system for solving the aforementioned problem is a control system that is applied to an engine in which fuel can be supplied into a same cylinder from both a first injection valve and a second injection valve. A fuel supply system of the engine to which this control system is applied has a first supply path through which fuel in a fuel tank is supplied to the first injection valve, and a second supply path through which fuel in the fuel tank is supplied to the second injection valve. Moreover, an electronic control unit of the control system is premised on a unit that controls fuel injection from the first injection valve and fuel injection from the second injection valve in accordance with an operating state of the engine. The electronic control unit is configured to determine whether or not there is a deviation between a property of fuel in the first supply path and a property of fuel in the second supply path, and execute a unilateral injection process for causing fuel to be injected from one of the first injection valve and the second injection valve and prohibiting fuel injection from the other injection valve, when it is determined that there is a deviation between the property of fuel in the first supply path and the property of fuel in the second supply path.

According to the aforementioned configuration, the electronic control unit executes the unilateral injection process when the electronic control unit determines that there is a deviation between the property of fuel in the first supply path and the property of fuel in the second supply path. In the engine, during the execution of the unilateral injection process, while fuel is injected from one of the first injection valve and the second injection valve, no fuel is injected from the other injection valve. Therefore, a phenomenon that fuels with different properties are supplied into the same cylinder from the separate injection valves does not occur. Accordingly, the combustion characteristics of the air-fuel mixture in the cylinder can be restrained from deteriorating as a result of a deviation between the property of fuel injected from the first injection valve and the property of fuel injected from the second injection valve.

Incidentally, in the case where the engine rotational speed is low as at the time of idling operation of the engine or the like, when the combustion characteristics of the air-fuel mixture in the cylinder deteriorate, the operating state of the engine is likely to be destabilized. For example, a stall of the engine becomes likely to occur as a result of a drop in the engine rotational speed due to a deterioration in the combustion characteristics. Thus, the electronic control unit preferably executes the unilateral injection process when the electronic control unit determines that the engine is in idling operation and that there is a deviation between the property of fuel in the first supply path and the property of fuel in the second supply path. According to this configuration, when the engine is in idling operation, the combustion characteristics of the air-fuel mixture in the cylinder are restrained from deteriorating, through the execution of the unilateral injection process. Therefore, the occurrence of the phenomenon that the operating state of the engine is destabilized can be suppressed.

Besides, when the vehicle runs, noise such as road noise or the like may be transmitted to a passenger in a vehicle interior, or vibration of a vehicle body generated at the time of running may be transmitted to the passenger. Therefore, even when noise or vibration occurs in the engine as a result of a deterioration in the combustion characteristics of the air-fuel mixture in the cylinder, the passenger is unlikely to feel uncomfortable. On the other hand, when the vehicle is stopped, noise such as road noise or the like or vibration of the vehicle body generated at the time of running does not occur as opposed to the time when the vehicle runs. Therefore, when noise or vibration occurs in the engine as a result of a deterioration in the combustion characteristics of the air-fuel mixture in the cylinder, the passenger is likely to feel uncomfortable. Thus, the electronic control unit preferably executes the unilateral injection process when the electronic control unit determines that the vehicle is stopped and that there is a deviation between the property of fuel in the first supply path and the property of fuel in the second supply path. According to this configuration, especially during stop of the vehicle when the passenger is likely to feel uncomfortable with noise or vibration resulting from a deterioration in the combustion characteristics of the air-fuel mixture, the combustion characteristics of the air-fuel mixture can be restrained from deteriorating, through the execution of the unilateral injection process. Therefore, the passenger can be made unlikely to feel uncomfortable during stop of the vehicle.

By the way, when the property of fuel in the fuel tank changes due to refueling or the like and the property of fuel in the fuel tank and the property of fuel stored in the fuel supply system deviate from each other, the fuel that is different in property from fuel stored earlier in the fuel supply system (i.e., fuel in the fuel tank) is supplied into the fuel supply system. In this case, the property of fuel in the first supply path and the property of fuel in the second supply path may deviate from each other.

It should be noted herein that the electronic control unit assumes that fuel stored in the fuel supply system before a change in the property of fuel in the fuel tank is old fuel, and assumes that fuel in the fuel tank is new fuel, when there is a deviation between the property of fuel in the fuel tank and the property of fuel stored in the fuel supply system due to the change in the property of fuel in the fuel tank. Besides, the electronic control unit assumes that that one of the first supply path and the second supply path in which old fuel remains is a specific supply path, and assumes that that one of the first injection valve and the second injection valve from which fuel in the specific supply path is injected is a specific injection valve.

In this case, the electronic control unit preferably causes fuel to be injected from the specific injection valve, and prohibits fuel injection from the other injection valve, namely, that one of the first injection valve and the second injection valve which is different from the specific injection valve. According to this configuration, old fuel can be removed from the interior of the specific supply path, and a situation where the interior of the specific supply path is filled with new fuel can be created at an early stage. That is, the unilateral injection process can be ended at an early stage. As a result, fuel injection control in which both the first injection valve and the second injection valve are used can be performed at an early stage.

Besides, the fuel supply system may have a fuel tank that stores fuel and a common path that is connected to the fuel tank, and may be configured such that upstream ends of both the first supply path and the second supply path are connected to a downstream end of the common path. Moreover, in the case where the common path is provided with a detection sensor that detects the property of fuel, the electronic control unit preferably determines whether there is a deviation between the property of fuel in the first supply path and the property of fuel in the second supply path, after the property of fuel detected by the detection sensor changes.

According to the aforementioned configuration, the property of fuel in the common path can be acquired. Therefore, when new fuel in the fuel tank flows into the common path through fuel injection from the injection valves, the detection sensor can acquire the property of new fuel. When the property of new fuel can thus be detected by the detection sensor, the electronic control unit determines whether there is a deviation between the property of fuel in the first supply path and the property of fuel in the second supply path. Then, upon determining that there is a deviation between the property of fuel in the first supply path and the property of fuel in the second supply path, the electronic control unit starts the unilateral injection process. Thus, the combustion characteristics of the air-fuel mixture in the cylinder can be restrained from deteriorating as a result of a deviation between the property of fuel injected from the first injection valve and the property of fuel injected from the second injection valve.

Incidentally, the volume of the first supply path and the volume of the second supply path are values that can be grasped in advance. Besides, the amount of fuel injection from the first injection valve and the amount of fuel injection from the second injection valve are values that can be estimated based on the time of energization of the injection valves, the number of times of injection from the injection valves or the like. Therefore, the electronic control unit may calculate at least one of a first estimated value of the amount of old fuel remaining in the first supply path and a second estimated value of the amount of new fuel flowing into the first supply path based on the volume of the first supply path and the amount of fuel injection from the first injection valve, and calculate at least one of a third estimated value of the amount of old fuel remaining in the second supply path and a fourth estimated value of the amount of new fuel flowing into the second supply path based on the volume of the second supply path and the amount of fuel injection from the second injection valve. In this case, the electronic control unit preferably determines whether there is a deviation between the property of fuel in the first supply path and the property of fuel in the second supply path, based on a calculation result of one of the calculated first estimated value and the calculated second estimated value and a calculation result of one of the calculated third estimated value and the calculated fourth estimated value.

According to the aforementioned configuration, for example, when the estimated value of the amount of old fuel remaining in the second supply path is larger than "0 (zero)" while the estimated value of the amount of old fuel remaining in the first supply path is equal to "0 (zero)", the electronic control unit can determine that there is a deviation between the property of fuel in the first supply path and the property of fuel in the second supply path. Besides, when the estimated value of the amount of old fuel remaining in the first supply path is larger than "0 (zero)" while the estimated value of the amount of old fuel remaining in the second supply path is equal to "0 (zero)" as well, the electronic control unit can determine that there is a deviation between the property of fuel in the first supply path and the property of fuel in the second supply path.

Besides, for example, when the estimated value of the amount of new fuel flowing into the second supply path is smaller than a value equivalent to the volume of the second supply path while the estimated value of the amount of new fuel flowing into the first supply path is equal to a value equivalent to the volume of the first supply path, the electronic control unit can determine that there is a deviation between the property of fuel in the first supply path and the property of fuel in the second supply path. Besides, when the estimated value of the amount of new fuel flowing into the first supply path is smaller than a value equivalent to the volume of the first supply path while the estimated value of the amount of new fuel flowing into the second supply path is equal to a value equivalent to the volume of the second supply path as well, the electronic control unit can determine that there is a deviation between the property of fuel in the first supply path and the property of fuel in the second supply path.

By the way, when the amount of fuel stored in the fuel tank increases, the electronic control unit can determine that refueling has been carried out. Then, there may be a deviation between the property of fuel supplied into the fuel tank through refueling and the property of fuel stored in the fuel tank and the fuel supply system before refueling. In this case, there is a deviation between the property of fuel stored in the fuel supply system before refueling and the property of fuel supplied into the fuel supply system from the fuel tank after refueling.

Thus, when the amount of fuel stored in the fuel tank increases, the electronic control unit determines that the fuel stored in the fuel supply system before the increase in the amount of fuel stored in the fuel tank is old fuel, and that the fuel in the fuel tank is new fuel. Then, when the electronic control unit makes a determination on the old fuel and the new fuel, the electronic control unit can also cause fuel to be injected from the specific injection valve and prohibit fuel injection from the other injection valve, namely, that one of the first injection valve and the second injection valve which is different from the specific injection valve.

According to this configuration, when there is actually a deviation between the property of old fuel as the fuel stored in the fuel supply system before refueling and the property of new fuel as the fuel newly supplied into the fuel supply system from the fuel tank after refueling, the phenomenon that fuels with different properties are supplied into the same cylinder from the separate injection valves does not occur, through the execution of the unilateral injection process. Also, old fuel can be removed from the interior of the specific supply path, and a situation where the interior of the specific supply path is filled with new fuel can be created at an early stage. Then, fuel injection control in which both the first injection valve and the second injection valve are used can be performed at an early stage by thus ending the unilateral injection process at an early stage.

Besides, when the amount of fuel stored in the fuel tank increases, the control system can also determine whether there is a deviation between the property of fuel in the first supply path and the property of fuel in the second supply path.

According to the aforementioned configuration, when the amount of fuel stored in the fuel tank increases, there may be a deviation between the property of new fuel in the fuel tank and the property of old fuel in the fuel supply system, so the electronic control unit determines whether there is a deviation between the property of fuel in the first supply path and the property of fuel in the second supply path. Therefore, when there may be a deviation between the property of fuel in the first supply path and the property of fuel in the second supply path, the unilateral injection process is executed in the electronic control unit. Thus, the combustion characteristics of the air-fuel mixture in the cylinder can be restrained from deteriorating as a result of a deviation between the property of fuel injected from the first injection valve and the property of fuel injected from the second injection valve.

Then, the electronic control unit may calculate at least one of a first estimated value of the amount of old fuel remaining in the first supply path and a second estimated value of the amount of new fuel flowing into the first supply path based on the volume of the first supply path and the amount of fuel injection from the first injection valve, and calculate at least one of a third estimated value of the amount of old fuel remaining in the second supply path and a fourth estimated value of the amount of new fuel flowing into the second supply path based on the volume of the second supply path and the amount of fuel injection from the second injection valve. In this case, the electronic control unit preferably determines whether there is a deviation between the property of fuel in the first supply path and the property of fuel in the second supply path, based on a calculation result of one of the calculated first estimated value and the calculated second estimated value and a calculation result of one of the calculated third estimated value and the calculated fourth estimated value.

Incidentally, the engine is provided with an air-fuel ratio sensor that detects a concentration of oxygen in exhaust gas flowing through an exhaust passage. The electronic control unit can estimate the air-fuel ratio of exhaust gas flowing through the exhaust passage, based on the concentration of oxygen that is detected by the air-fuel ratio sensor. Then, in the case where there is a deviation between the property of fuel injected from the first injection valve and the property of fuel injected from the second injection valve, when the injection sharing ratio changes, the air-fuel ratio of exhaust gas that is estimated based on a result of detection by the air-fuel ratio sensor changes. Incidentally, the injection sharing ratio is a value obtained by dividing the amount of fuel injection from the first injection valve by the sum of the amount of fuel injection from the first injection valve and the amount of fuel injection from the second injection valve.

Thus, the electronic control unit may determine that there is a deviation between the property of fuel in the first supply path and the property of fuel in the second supply path, when the air-fuel ratio of exhaust gas flowing through the exhaust passage of the engine changes due to a change in the injection sharing ratio. According to this configuration, the timing for starting the unilateral injection process can be determined even if a sensor for detecting the property of fuel or the like is not newly provided.

Incidentally, in the case where alcohol-containing fuel is used, the property of fuel means the concentration of alcohol in fuel. In this case, the electronic control unit preferably determines whether there is a deviation between the concentration of alcohol in the fuel in the first supply path and the concentration of alcohol in the fuel in the second supply path. According to this configuration, when the electronic control unit determines that there is a deviation between the concentration of alcohol in the fuel in the first supply path and the concentration of alcohol in the fuel in the second supply path, the unilateral injection process can be executed in the electronic control unit.

Incidentally, the electronic control unit can be applied to the engine that is equipped with both the first injection valve that injects fuel into an intake passage, and the second injection valve that injects fuel into the cylinder.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
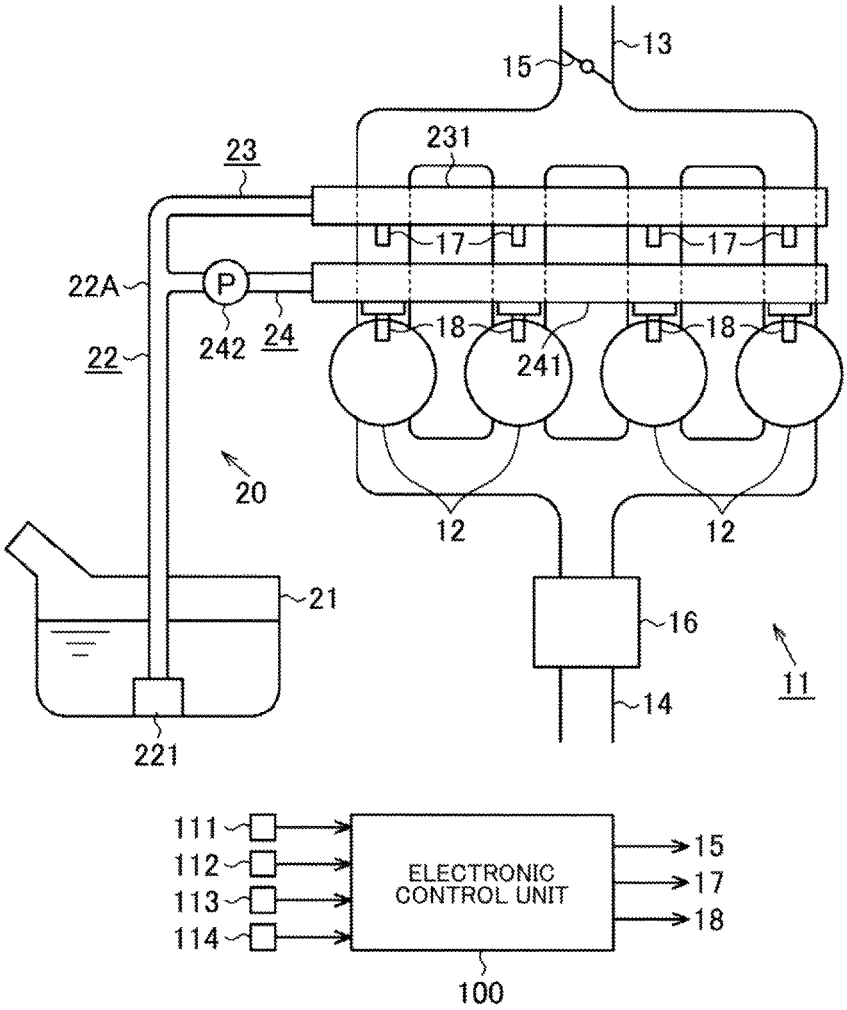
FIG. 1 is a configuration view showing the outline of a control system according to the first embodiment of the invention.

A control system according to the first embodiment of the invention will be described hereinafter with reference to FIGS. 1 to 15. FIG. 1 shows an engine 11 that is equipped with an electronic control unit 100 as a control system for an engine according to the present embodiment of the invention. The engine 11 is an engine in which alcohol-mixed fuel as a mixture of gasoline and alcohol can be used in addition to gasoline.

As shown in FIG. 1, the engine 11 is equipped with a plurality of cylinders 12, an intake passage 13 that communicates with the interiors of the respective cylinders 12, and an exhaust passage 14 that communicates with the respective cylinders 12. A throttle valve 15 that adjusts the amount of intake air flowing into each of the cylinders 12 is provided in the intake passage 13. This intake passage 13 branches off into the respective cylinders downstream of the throttle valve 15. The exhaust passage 14 is provided with an exhaust gas purification device 16 for purifying the exhaust gas flowing in the exhaust passage 14.

Besides, the engine 11 is equipped with first injection valves 17 that inject fuel into the intake passage 13 downstream of the throttle valve 15, and second injection valves 18 that directly inject fuel into the cylinders 12 respectively. In the engine 11, the cylinders 12 are provided with both the first injection valves 17 and the second injection valves 18 respectively. That is, a plurality of injection valves capable of supplying fuel are provided for the same cylinder 12. Moreover, in the engine 11, an air-fuel mixture containing the fuel injected from at least either the first injection valves 17 or the second injection valves 18 and the air introduced into the cylinders 12 through the intake passage 13 is burned in the cylinders 12. Thus, a crankshaft of the engine 11 rotates.

As shown in FIG. 1, the engine 11 is provided with a fuel supply system 20 for supplying the fuel stored in a fuel tank 21 to both the first injection valves 17 and the second injection valves 18. The fuel supply system 20 is equipped with a common path 22, a first supply path 23 and a second supply path 24. An upstream end of the common path 22, which is located at a lower end in the drawing, is connected to the fuel tank 21. The first supply path 23 is connected to a downstream end 22A of the common path 22, which is located at an upper end in the drawing. The second supply path 24 is connected to the downstream end 22A of the common path 22. A feed pump 221 that pumps out the fuel in the fuel tank 21 into the common path 22 is provided at the upstream end of the common path 22.

The first supply path 23 is configured to be equipped with a first delivery pipe 231 in which the fuel supplied to the first injection valves 17 is temporarily stored. The second supply path 24 is configured to be equipped with a second delivery pipe 241 in which the fuel supplied to the second injection valves 18 is temporarily stored. The second supply path 24 is provided with a high-pressure fuel pump 242 that further pressurizes the fuel pumped out from the fuel tank 21 by the feed pump 221. Therefore, the pressure in the second delivery pipe 241 is higher than the pressure in the first delivery pipe 231.

As shown in FIG. 1, a vehicle speed sensor 111, a crank angle sensor 112, an air-fuel ratio sensor 113 and a property detection sensor 114 are electrically connected to the electronic control unit 100. The vehicle speed sensor 11 is a sensor that detects a vehicle speed VS as a speed of a vehicle that is mounted with the engine 11. The crank angle sensor 112 is a sensor that detects an engine rotational speed NE as a rotational speed of the crankshaft of the engine 11. Besides, the air-fuel ratio sensor 113 is a sensor that detects a concentration of oxygen in exhaust gas flowing in the exhaust passage 14 upstream of the exhaust gas purification device 16. Moreover, the electronic control unit 100 can estimate an air-fuel ratio of the air-fuel mixture (e.g., exhaust gas) burned in the cylinders 12, based on the concentration of oxygen in exhaust gas detected by this air-fuel ratio sensor 113. Besides, the property detection sensor 114 is an exemplary detection sensor that detects a property of fuel, and is arranged at a location that makes it possible to detect the property of fuel at the downstream end 22A of the common path 22. As described above, the engine 11 is an engine in which alcohol-containing fuel can be used. Therefore, the property detection sensor 114 detects a concentration of alcohol in the fuel at the downstream end 22A of the common path 22.

Then, the electronic control unit 100 controls the throttle valve 15, the respective first injection valves 17 and the respective second injection valves 18 based on information detected by a detection system constituted of the respective sensors 111 to 114 and the like. That is, the fuel supply system includes the fuel supply system 20, the property detection sensor 114 and the electronic control unit 100.

The electronic control unit 100 for the engine 11 controls fuel injection from the first injection valves 17 and fuel injection from the second injection valves 18 in accordance with an injection sharing ratio that is determined by an operating range of the engine 11 or the like. Incidentally, the injection sharing ratio is a value obtained by dividing an amount of fuel injection from the first injection valves 17 by a sum of the amount of fuel injection from the first injection valves 17 and an amount of fuel injection from the second injection valves 18. In the case where the injection sharing ratio is "1", while fuel is injected from the first injection valves 17, no fuel is injected from the second injection valves 18. Besides, in the case where the injection sharing ratio is "0 (zero)", while fuel is injected from the second injection valves 18, no fuel is injected from the first injection valves 17. Besides, in the case where the injection sharing ratio assumes a value larger than "0 (zero)" and smaller than "1", fuel is injected from both the first injection valves 17 and the second injection valves 18.

A relationship between the operating range of the engine 11 and fuel injection control will now be described with reference to a map shown in FIG. 2. Incidentally, "port injection" means fuel injection from the first injection valves 17, and "in-cylinder injection" means fuel injection from the second injection valves 18.

Figure 2:
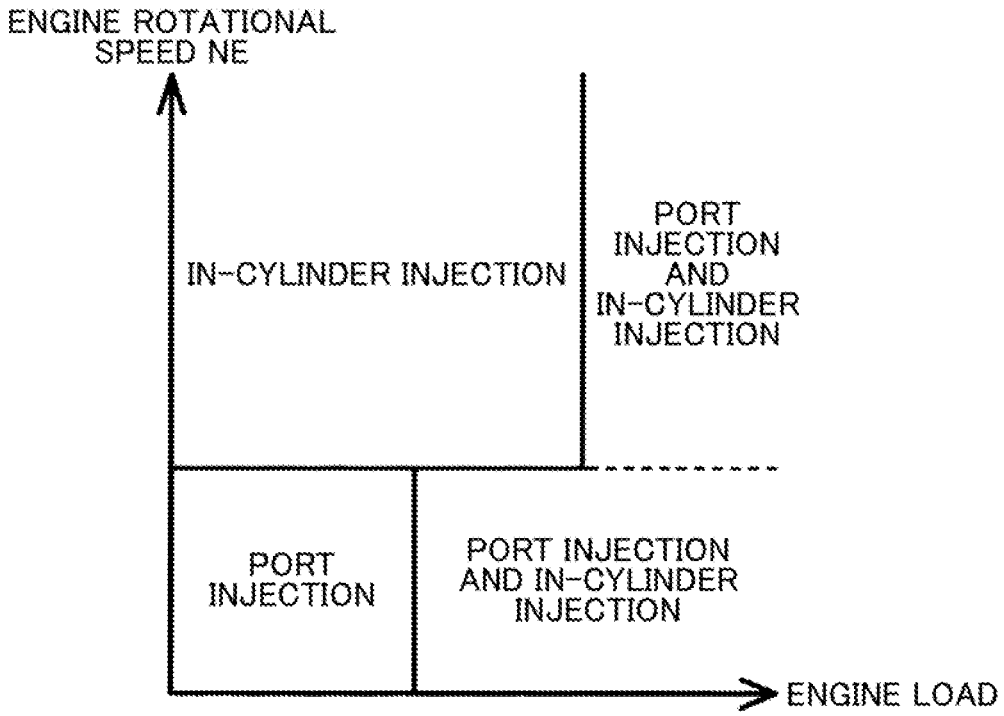
FIG. 2 is a map showing a control mode of injection valves in accordance with an engine rotational speed and an engine load in an engine.

As shown in FIG. 2, in an operating range of the engine 11 where both the engine rotational speed NE and the engine load are low, the injection sharing ratio is "L", so only port injection is carried out, and in-cylinder injection is not carried out. Moreover, idling operation of the engine 11 is included in this operating range.

Incidentally, when the engine 11 is in idling operation, in-cylinder injection is basically not carried out in the engine 11, but in-cylinder injection may be exceptionally carried out. That is, when engine operation in which in-cylinder injection is not carried out is continued, the temperature of the second injection valves 18 rises due to the heat generated in the cylinders 12 and the like. When the temperature of the second injection valves 18 thus rises, the temperature of fuel stagnating in the second injection valves 18 excessively rises, so fuel may gasify in the second injection valves 18. When fuel thus gasifies, the controllability of fuel injection from the second injection valves 18 decreases. Therefore, even in the case where the engine 11 is in idling operation in which in-cylinder injection is intrinsically not carried out, fuel may be injected from the second injection valves 18 when it is determined that fuel may gasify in the second injection valves 18.

Besides, various diagnosis processes are executed in the engine 11. These diagnosis processes include those which need both port injection and in-cylinder injection. As an example of these diagnosis processes, it is possible to mention, for example, an imbalance diagnosis for detecting a degree of dispersion of the amount of fuel supplied into the cylinders 12 among the cylinders. Then, in the case where these diagnosis processes are executed when the engine 11 is in idling operation in which in-cylinder injection is intrinsically not carried out, in-cylinder injection may be carried out in addition to port injection or instead of port injection.

Besides, as shown in FIG. 2, when the engine 11 is in an operating range where the engine load is not very high and the engine rotational speed NE is high, the injection sharing ratio is "0 (zero)", so only in-cylinder injection is carried out, and port injection is not carried out. Besides, when the engine 11 is in an operating range where the engine rotational speed NE is not very high and the engine load is high, the injection sharing ratio assumes a value that is larger than "0 (zero)" and smaller than "1", so both port injection and in-cylinder injection are carried out.

Furthermore, when the engine 11 that is operated through the use of alcohol-containing fuel is in an operating range where both the engine rotational speed NE and the engine load are high, the injection sharing ratio assumes a value that is larger than "0 (zero)" and smaller than "1", both port injection and in-cylinder injection are carried out. The air-fuel mixture is less likely to burn in the case where alcohol-containing fuel is used than in the case where non-alcohol-containing fuel is used. Therefore, in the case where alcohol-containing fuel is used, the amount of fuel injection in one cycle is made large. Accordingly, in a high-rotation high-load operating range, in-cylinder injection alone may not allow a sufficient amount of fuel that is necessary for combustion to be supplied into the cylinders 12. Therefore, port injection as well as in-cylinder injection is carried out. Thus, good combustion characteristics of the air-fuel mixture can be ensured.

By the way, the fuel supply system 20 may be supplied with a plurality of types of fuel with different properties, namely, different concentrations of alcohol. Moreover, the combustion characteristics of the air-fuel ratio mixture in the cylinders 12 differ depending on whether a fuel with a first concentration of alcohol or a fuel with a second concentration of alcohol that is different from the first concentration of alcohol is used. Therefore, when the engine 11 is in operation through the use of the fuel with the first concentration of alcohol, fuel injection control for the fuel is performed. On the other hand, when the engine 11 is in operation through the use of the fuel with the second concentration of alcohol, fuel injection control for the fuel is performed.

Incidentally, the injection sharing ratio is set on the premise that there is no deviation between the concentration of alcohol in the fuel injected from the first injection valves 17 and the concentration of alcohol in the fuel injected from the second injection valves 18. Therefore, when there is a deviation between the concentration of alcohol in the fuel injected from the first injection valves 17 and the concentration of alcohol in the fuel injected from the second injection valves 18, the injection sharing ratio cannot be appropriately set, so the combustion characteristics of the air-fuel mixture in each of the cylinders 12 may deteriorate. This phenomenon occurs when the aforementioned injection sharing ratio assumes a value that is larger than "0 (zero)" and smaller than "1" and fuel injection is carried out from both the first injection valves 17 and the second injection valves 18. Accordingly, it is necessary to monitor whether or not there is a deviation between the concentration of alcohol in the fuel in the first supply path 23 and the concentration of alcohol in the fuel in the second supply path 24. Incidentally, a state where there is a deviation between the concentration of alcohol in the fuel in the first supply path 23 and the concentration of alcohol in the fuel in the second supply path 24 arises through, for example, the supply of a fuel with a concentration of alcohol that is different from the concentration of alcohol in the fuel stored in the fuel supply system 20 into the fuel tank 21.

An exemplary method of determining whether or not the fuel with the concentration of alcohol that is different from the concentration of alcohol in the fuel stored in the fuel supply system 20 has reached the downstream end 22A in the common path 22, and an exemplary method of estimating the concentration of alcohol in the fuel in the first supply path 23 and the concentration of alcohol in the fuel in the second supply path 24 will now be described with reference to FIGS. 3 to 8.

When refueling is carried out, the fuel stored in the fuel tank 21 before refueling and newly supplied fuel are mixed with each other in the fuel tank 21. Therefore, when there is a deviation between the concentration of alcohol in the fuel stored in the fuel tank 21 before refueling and the concentration of alcohol in the fuel newly supplied into the fuel tank 21, there is a deviation between the concentration of alcohol in the fuel in the fuel supply system 20 (i.e., in the common path 22, the first supply path 23 and the second supply path 24) and the concentration of alcohol in the fuel in the fuel tank 21.

Thus, in the present embodiment of the invention, when there is a deviation between the concentration of alcohol in the fuel in the fuel tank 21 and the concentration of alcohol in the fuel stored in the fuel supply system 20 due to a change in the concentration of alcohol in the fuel in the fuel tank 21, the electronic control unit 100 assumes that the fuel stored in the fuel supply system 20 before the change in the concentration of alcohol in the fuel in the fuel tank 21 is "old fuel", and assumes that the fuel in the fuel tank 21 is "new fuel". Incidentally, in FIGS. 3 to 8, old fuel stagnates in a range where there are a large number of dots, and new fuel stagnates in a range where there are a large number of oblique lines.

Figure 3:
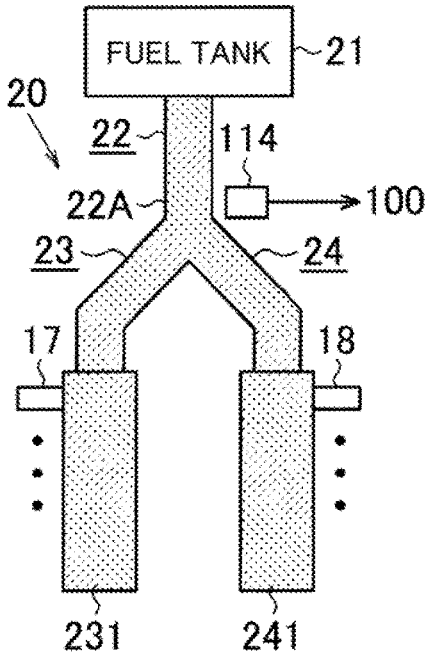
FIG. 3 is a schematic view showing how a common path, a first supply path and a second supply path are filled with old fuel in a fuel supply system of the engine.

FIG. 3 shows a state immediately after a change in the concentration of alcohol in the fuel in the fuel tank 21 as a result of refueling or the like. As shown in FIG. 3, immediately after a change in the concentration of alcohol in the fuel in the fuel tank 21, new fuel stagnates only in the fuel tank 21, and the interiors of the common path 22, the first supply path 23 and the second supply path 24 are filled with old fuel. When the engine 11 is operated in this state and old fuel is injected from the injection valves 17 and 18, new fuel flows into the common path 22 from the interior of the fuel tank 21. In the case where old fuel still remains in the common path 22 in this manner, regardless of whether old fuel is injected from the first injection valves 17 or the second injection valves 18, an amount of new fuel matching the amount of fuel injection from the injection valves 17 and 18 flows into the common path 22.

Figure 4:
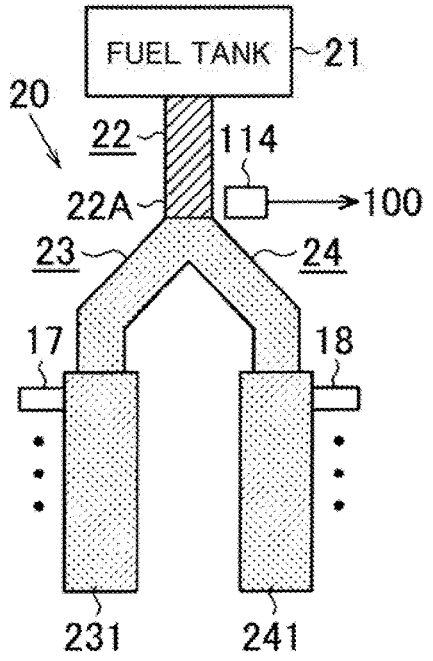
FIG. 4 is a schematic view showing how old fuel disappears from the common path and the interior of the common path is filled with new fuel in the fuel supply system.

Then, when the injection of old fuel by the injection valves 17 and 18 is thus continued, the interior of the common path 22 is filled with new fuel, and no old fuel remains in the common path 22, as shown in FIG. 4. As described above, the electronic control unit 100 according to the present embodiment of the invention can detect the concentration of alcohol in the fuel stagnating at the downstream end 22A of the common path 22, based on a result of detection by the property detection sensor 114.

That is, when new fuel reaches the downstream end 22A in the common path 22, the concentration of alcohol detected by the property detection sensor 114 changes, so the electronic control unit 100 according to the present embodiment of the invention can determine that new fuel has reached the downstream end 22A in the common path 22.

Incidentally, even when refueling is carried out, the concentration of alcohol in fuel in the fuel tank 21 may not change. In this case, the electronic control unit 100 that makes the aforementioned determination through the use of the result of detection by the property detection sensor 114 cannot distinguish between the fuel supplied into the fuel supply system 20 from the fuel tank 21 after refueling and the fuel stored in the fuel supply system 20 before refueling.

After it is determined, based on a change in the result of detection by the property detection sensor 114, that new fuel has reached the downstream end 22A in the common path 22, the estimation of the concentration of alcohol in the fuel in the first supply path 23 and the estimation of the concentration of alcohol in the fuel in the second supply path 24 are carried out. That is, the volume of the first supply path 23 and the volume of the second supply path 24 are values that can be grasped in advance. Besides, the total amount of old fuel injected by the respective first injection valves 17 after it is determined that new fuel has reached the downstream end 22A in the common path 22 can be estimated based on the total time of energization of the respective first injection valves 17, the number of times of injection by the respective first injection valves 17 or the like. By the same token, the total amount of old fuel injected by the second injection valves 18 after it is determined that new fuel has reached the downstream end 22A in the common path 22 can be estimated based on the time of energization of the respective second injection valves 18, the number of times of injection by the second injection valves 18 or the like.

Figure 5:
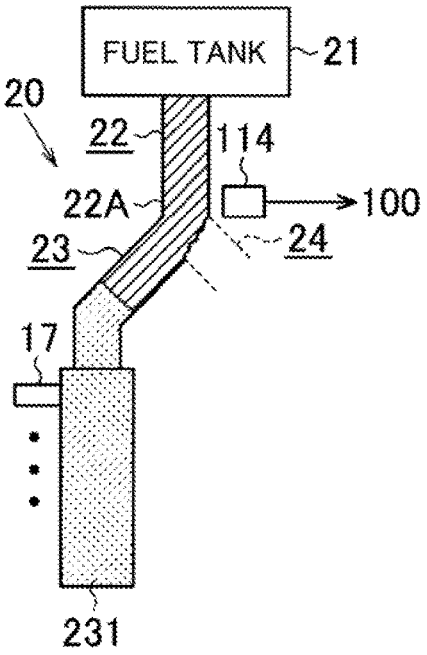
FIG. 5 is a schematic view showing how new fuel flows into the first supply path in the fuel supply system.
Figure 6:
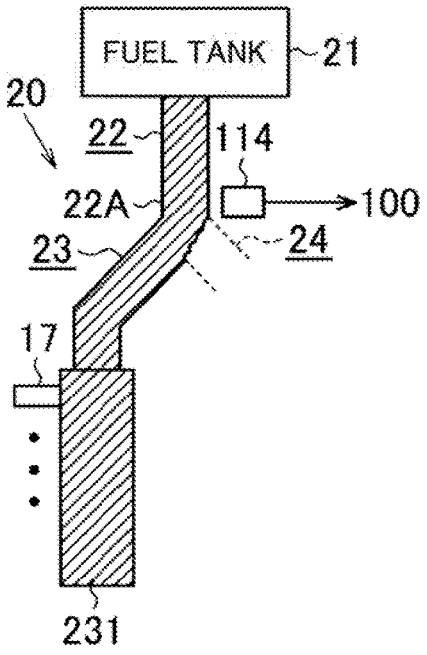
FIG. 6 is a schematic view showing how old fuel disappears from the first supply path and the interior of the first supply path is filled with new fuel in the fuel supply system.

FIGS. 5 and 6 schematically show how the amount of old fuel in the first supply path 23 gradually decreases due to the injection of old fuel by the first injection valves 17. At a time point when it is determined that new fuel has reached the downstream end 22A in the common path 22, the interior of the first supply path 23 is filled with old fuel. The amount of old fuel remaining at this time is referred to as "a first old fuel fill-up value". This first old fuel fill-up value is a value that is correlated with the volume of the first supply path 23, and is a value that can be grasped in advance. Then, when old fuel is injected from the first injection valves 17, the amount of old fuel remaining in the first supply path 23 gradually decreases, whereas the amount of new fuel flowing into the first supply path 23 gradually increases.

That is, the total amount of injection of old fuel by the respective first injection valves 17 after it is determined that new fuel has reached the downstream end 22A in the common path 22 is equivalent to the amount of new fuel flowing into the first supply path 23, and the difference obtained by subtracting the total amount of injection of old fuel by the respective first injection valves 17 from the first old fuel fill-up value is equivalent to the amount of old fuel remaining in the first supply path 23. Therefore, the electronic control unit 100 can calculate the estimated value of the amount of old fuel remaining in the first supply path 23, based on the volume of the first supply path 23 and the total amount of injection of fuel from the respective first injection valves 17 after it is determined that new fuel has reached the downstream end 22A in the common path 22. That is, the estimated value of the amount of old fuel remaining in the first supply path 23 decreases as the total amount of injection of old fuel by the respective first injection valves 17 after it is determined that new fuel has reached the downstream end 22A in the common path 22 increases.

Then, when the estimated value of the amount of remaining old fuel becomes equal to or smaller than "0 (zero)", no old fuel remains in the first supply path 23 already, and it can be determined that the concentration of alcohol in the fuel in the first supply path 23 has become equal to the concentration of alcohol in new fuel.

Figure 7:
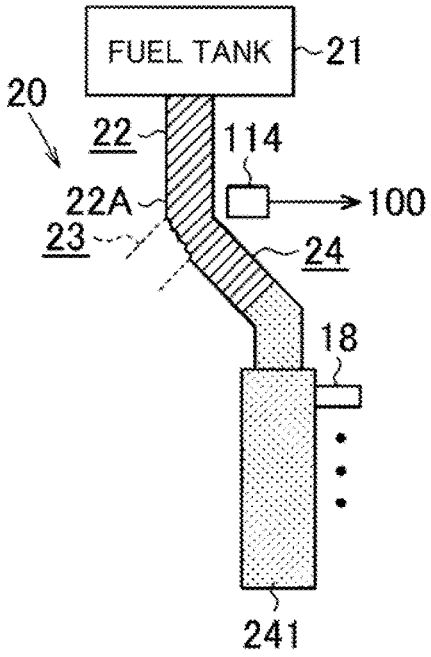
FIG. 7 is a schematic view showing how new fuel flows into the second supply path in the fuel supply system.
Figure 8:
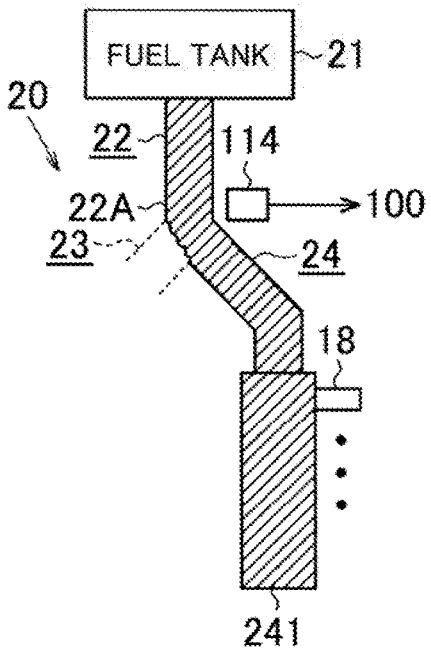
FIG. 8 is a schematic view showing how old fuel disappears from the second supply path and the interior of the second supply path is filled with new fuel in the fuel supply system.

On the other hand, FIGS. 7 and 8 schematically show how the amount of old fuel remaining in the second supply path 24 gradually decreases due to the injection of old fuel by the second injection valves 18. At a time point when it is determined that new fuel has reached the downstream end 22A in the common path 22, the interior of the second supply path 24 is filled with old fuel. The amount of old fuel remaining at this time is referred to as "a second old fuel fill-up value". This second old fuel fill-up value is a value that is correlated with the volume of the second supply path 24, and is a value that can be grasped in advance. Then, when old fuel is injected from the second injection valves 18, the amount of old fuel remaining in the second supply path 24 gradually decreases, whereas the amount of new fuel flowing into the second supply path 24 gradually increases.

That is, the total amount of injection of old fuel by the respective second injection valves 18 after it is determined that new fuel has reached the downstream end 22A in the common path 22 is equivalent to the amount of new fuel flowing into the second supply path 24, and the difference obtained by subtracting the total amount of injection of old fuel by the second injection valves 18 from the second old fuel fill-up value is equivalent to the amount of old fuel remaining in the second supply path 24. Therefore, the estimated value of the amount of old fuel remaining in the second supply path 24 can be calculated based on the volume of the second supply path 24 and the total amount of injection of fuel from the respective second injection valves 18 after it is determined that new fuel has reached the downstream end 22A in the common path 22. That is, the estimated value of the amount of old fuel remaining in the second supply path 24 decreases as the total amount of injection of old fuel by the second injection valves 18 after it is determined that new fuel has reached the downstream end 22A in the common path 22 increases.

Then, when the estimated value of the amount of remaining old fuel becomes equal to or smaller than "0 (zero)", no old fuel remains in the second supply path 24 already, and it can be determined that the concentration of alcohol in the fuel in the second supply path 24 has become equal to the concentration of alcohol in new fuel.

When no old fuel remains in one of the first supply path 23 and the second supply path 24 and old fuel still remains in the other supply path after it is determined that new fuel has reached the downstream end 22A in the common path 22, the electronic control unit 100 according to the present embodiment of the invention determines that there is a deviation between the concentration of alcohol in the fuel in the first supply path 23 and the concentration of alcohol in the fuel in the second supply path 24. Then, when there is a deviation between the concentration of alcohol in the fuel in the first supply path 23 and the concentration of alcohol in the fuel in the second supply path 24, the electronic control unit 100 executes a unilateral injection process for causing fuel to be injected from either the first injection valves 17 or the second injection valves 18 and prohibiting fuel injection from the other injection valves. By executing this unilateral injection process, the combustion characteristics of the air-fuel mixture can be restrained from deteriorating as a result of the injection of fuel with different concentrations of alcohol from the separate injection valves.

Incidentally, in the case where the engine rotational speed NE is low as at the time of idling operation of the engine 11 or the like, when the combustion characteristics of the air-fuel mixture in the cylinders 12 deteriorate, the operating state of the engine 11 is likely to be destabilized. For example, a stall of the engine resulting from a drop in the engine rotational speed NE due to the deterioration in the combustion characteristics becomes likely to occur. On the other hand, in the case where the engine rotational speed NE is relatively high, even when the combustion characteristics of the air-fuel mixture deteriorate as a result of the injection of fuels with different concentrations of alcohol from the separate injection valves, the operating state of the engine 11 is unlikely to be destabilized.

Besides, when the vehicle runs, noise such as road noise or the like is transmitted to a passenger in a vehicle interior, or vibration of a vehicle body generated at the time of running is transmitted to the passenger. Therefore, even when noise or vibration occurs in the engine 11 as a result of a deterioration in the combustion characteristics of the air-fuel mixture in the cylinders 12, the passenger is unlikely to feel uncomfortable. On the other hand, when the vehicle is stopped, noise such as road noise or the like or vibration of the vehicle body generated at the time of running of the vehicle does not occur, as opposed to the time when the vehicle runs. Therefore, when noise or vibration occurs in the engine 11 as a result of a deterioration in the combustion characteristics of the air-fuel mixture in the cylinders 12, the passenger is likely to feel uncomfortable.

Thus, in the electronic control unit 100) according to the present embodiment of the invention, the condition for executing the unilateral injection process includes both a condition that the engine 11 is in idling operation and a condition that the vehicle is stopped. That is, even in the case where there is a deviation between the concentration of alcohol in the fuel in the first supply path 23 and the concentration of alcohol in the fuel in the second supply path 24, when the operating engine of the engine 11 is unlikely to be destabilized and the passenger is unlikely to feel uncomfortable even if the combustion characteristics of the air-fuel mixture deteriorate as a result of the injection of fuels with different concentrations of alcohol from the separate injection valves, the unilateral injection process is not executed. Accordingly, injection control of the first injection valves 17 and injection control of the second injection valves 18 can be performed based on the injection sharing ratio corresponding to the operating state of the engine 11 at that time.

Incidentally, under the situation where there is a deviation between the concentration of alcohol in the fuel injected from the first injection valves 17 and the concentration of alcohol in the fuel injected from the second injection valves, some learning processes and some diagnosis processes cannot be executed. Therefore, with a view to starting the execution of these processes at an early stage, the state where there is a deviation between the concentration of alcohol in the fuel injected from the first injection valves 17 and the concentration of alcohol in the fuel injected from the second injection valves 18 needs to be eliminated at an early stage.

Thus, that one of the first supply path 23 and the second supply path 24 in which old fuel remains is assumed to be a specific supply path, and those of the first injection valves 17 and the second injection valves 18 which inject the fuel in the specific supply path are assumed to be specific injection valves. In this case, in the unilateral injection process, the electronic control unit 100 according to the present embodiment of the invention causes fuel to be injected from the specific injection valves, and prohibits fuel injection from the other injection valves, namely, those of the first injection valves 17 and the second injection valves 18 which are different from the specific injection valves. Thus, old fuel disappears from the interior of the specific supply path at an early stage, and a situation where the interior of the specific supply path is filled with new fuel is created at an early stage. That is, the state where there is a deviation between the concentration of alcohol in the fuel injected from the first injection valves 17 and the concentration of alcohol in the fuel injected from the second injection valves 18 is eliminated at an early stage through the execution of the unilateral injection process.

Figure 9:
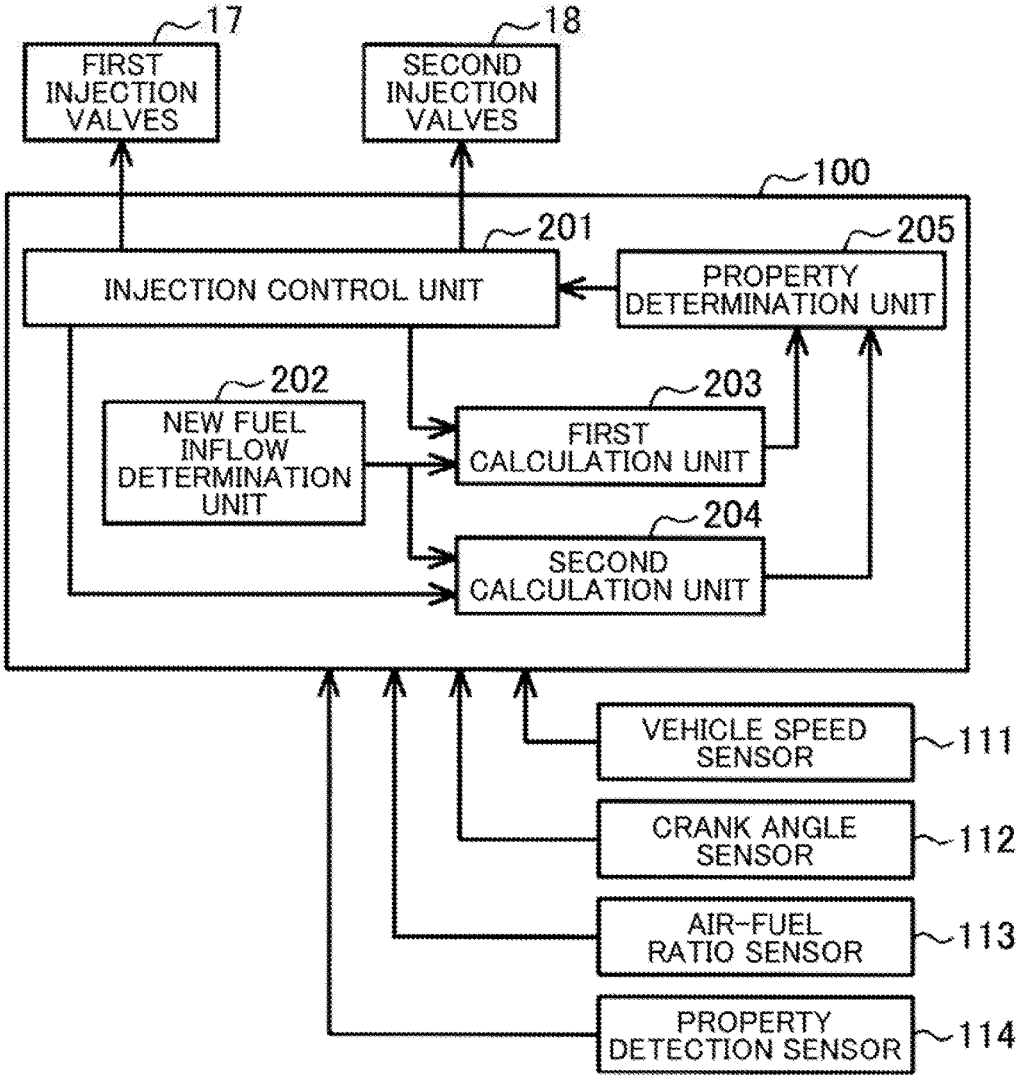
FIG. 9 is a block diagram showing the functional configuration of the control system.

Next, the functional configuration of the electronic control unit 100 according to the present embodiment of the invention will be described with reference to FIG. 9. As shown in FIG. 9, the electronic control unit 100 has an injection control unit 201, a new fuel inflow determination unit 202, a first calculation unit 203, a second calculation unit 204 and a property determination unit 205 as functional units that are constituted by at least one of software and hardware. Incidentally, the control in the injection control unit 201, the new fuel inflow determination unit 202, the first calculation unit 203, the second calculation unit 204 and the property determination unit 205 may be considered to be performed by the electronic control unit 100.

The injection control unit 201 controls the first injection valves 17 and the second injection valves 18 based on the aforementioned injection sharing ratio corresponding to the operating situation of the engine 11. Besides, when the information that there is a deviation between the concentration of alcohol in the fuel in the first supply path 23 and the concentration of alcohol in the fuel in the second supply path 24 has been input to the injection control unit 201 from the property determination unit 205 under the situation where the engine 11 is in idling operation and the vehicle is stopped, the injection control unit 201 executes the aforementioned unilateral injection process.

The new fuel inflow determination unit 202 monitors a concentration of alcohol in fuel detected by the property detection sensor 114. The property detection sensor 114 detects the concentration of alcohol in the fuel at the downstream end 22A in the common path 22. Therefore, when the concentration of alcohol in fuel detected by the property detection sensor 114 changes, the new fuel inflow determination unit 202 determines that new fuel has reached the downstream end 22A in the common path 22. Then, upon determining that new fuel has reached the downstream end 22A in the common path 22, the new fuel inflow determination unit 202 outputs this information to both the first calculation unit 203 and the second calculation unit 204.

When the information that new fuel has reached the downstream end 22A in the common path 22 is input to the first calculation unit 203 from the new fuel inflow determination unit 202, the first calculation unit 203 calculates an estimated value Y1 of the amount of old fuel remaining in the first supply path 23. Then, the first calculation unit 203 outputs the calculated estimated value Y1 of the amount of old fuel remaining in the first supply path 23 to the property determination unit 205.

When the information that new fuel has reached the downstream end 22A in the common path 22 is input to the second calculation unit 204 from the new fuel inflow determination unit 202, the second calculation unit 204 calculates an estimated value Y2 of the amount of old fuel remaining in the second supply path 24. Then, the second 25 calculation unit 204 outputs the calculated estimated value Y2 of the amount of old fuel remaining in the second supply path 24 to the property determination unit 205.

The property determination unit 205 determines whether or not there is a deviation between the concentration of alcohol in the fuel in the first supply path 23 and the concentration of alcohol in the fuel in the second supply path 24, through the use of the information input from the first calculation unit 203 and the information input from the second calculation unit 204. Then, upon determining that there is a deviation between the concentration of alcohol in the fuel in the first supply path 23 and the concentration of alcohol in the fuel in the second supply path 24, the property determination unit 205 outputs this information to the injection control unit 201. Incidentally, in thus outputting the information that there is a deviation to the injection control unit 201, the property determination unit 205 also outputs, to the injection control unit 201, information on the supply path in which old fuel still remains, namely, the specific supply path.

Next, a processing routine that is executed by the new fuel inflow determination unit 202 of the electronic control unit 100 to determine that new fuel has reached the downstream end 22A in the common path 22 will be described with reference to a flowchart shown in FIG. 10.

Figure 10:
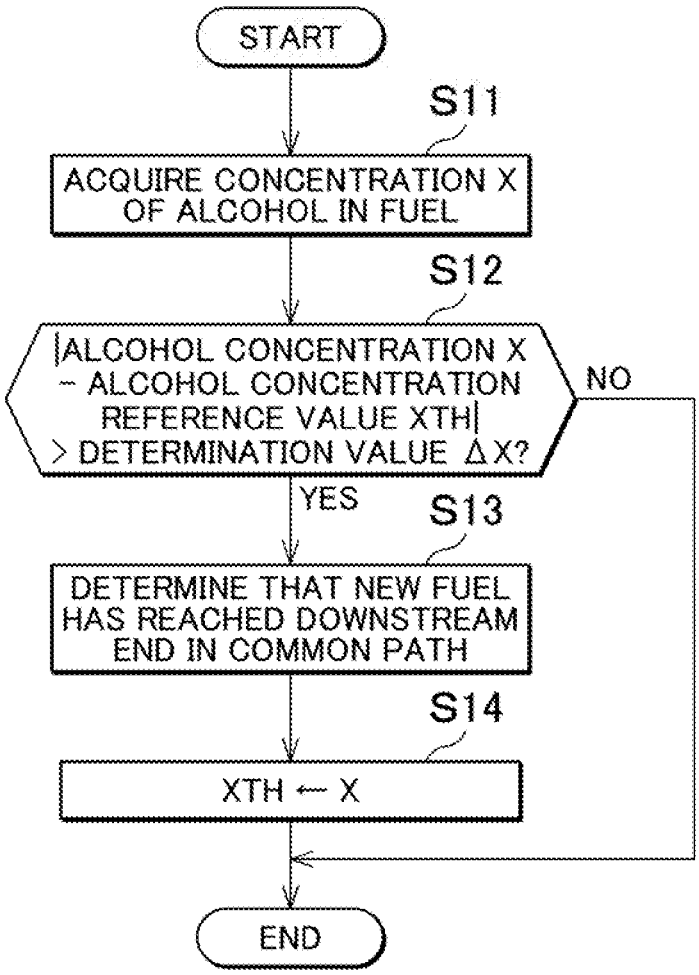
FIG. 10 is a flowchart showing a processing routine that is executed to determine whether new fuel has reached a downstream end in the common path in the control system.

As shown in FIG. 10, the new fuel inflow determination unit 202 acquires a concentration X of alcohol in fuel detected by the property detection sensor 114 (step S11). Subsequently, the new fuel inflow determination unit 202 calculates a difference between the acquired concentration X of alcohol in fuel at the moment and an alcohol concentration reference value XTH, and determines whether or not the difference is larger than a determination value ΔX (step S12). The alcohol concentration reference value XTH is set to a value that is approximately equal to the concentration of alcohol in the fuel stored in the fuel supply system 20 before a change in the concentration of alcohol in the fuel in the fuel tank 21. Therefore, when the difference (=|X−XTH|) is larger than the determination value ΔX, it can be determined that new fuel has reached the downstream end 22A in the common path 22.

Accordingly, if the difference (=|X−XTH|) is equal to or smaller than the determination value ΔX (NO in step S12), the new fuel inflow determination unit 202 temporarily ends the present processing routine. On the other hand, if the difference is larger than the determination value ΔX (YES in step S12), the new fuel inflow determination unit 202 determines that new fuel has reached the downstream end 22A in the common path 22 (step S13). Then, the new fuel inflow determination unit 202 assigns the concentration X of alcohol in fuel at the moment acquired in step S11, to the alcohol concentration reference value XTH (step S14), and ends the present processing routine.

Next, a processing routine that is executed by the first calculation unit 203 of the electronic control unit 100 in calculating the estimated value Y1 of the amount of old fuel remaining in the first supply path 23 will be described with reference to a flowchart shown in FIG. 11.

Figure 11:
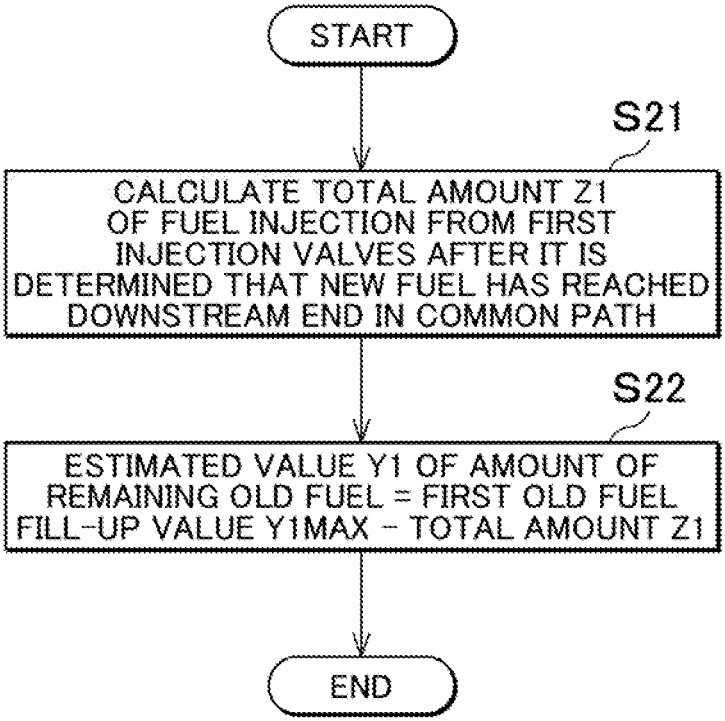
FIG. 11 is a flowchart showing a processing routine that is executed to estimate an amount of old fuel remaining in the first supply path in the control system.

As shown in FIG. 11, the first calculation unit 203 calculates a total amount Z1 of fuel injection from the respective first injection valves 17 after it is determined that new fuel has reached the downstream end 22A in the common path 22 (step S21). Then, the first calculation unit 203 subtracts the total amount Z1 of fuel injection from the respective first injection valves 17 from the aforementioned first old fuel fill-up value Y1MAX, which is correlated with the volume of the first supply path 23, sets the difference (=Y1MAX−Z1) as the estimated value Y1 of the amount of old fuel remaining in the first supply path 23 (step S22), and ends the present processing routine.

Next, a processing routine that is executed by the second calculation unit 204 of the electronic control unit 100 in calculating the estimated value Y2 of the amount of old fuel remaining in the second supply path 24 will be described with reference to a flowchart shown in FIG. 12.

Figure 12:
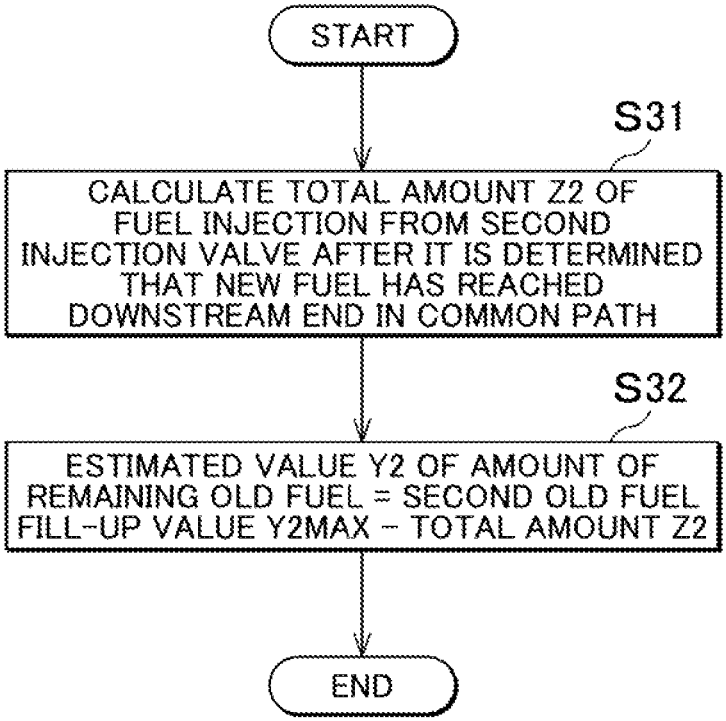
FIG. 12 is a flowchart showing a processing routine that is executed to estimate an amount of old fuel remaining in the second supply path in the control system.

As shown in FIG. 12, the second calculation unit 204 calculates a total amount Z2 of fuel injection from the respective second injection valves 18 after it is determined that new fuel has reached the downstream end 22A in the common path 22 (step S31). Then, the second calculation unit 204 subtracts the total amount Z2 of fuel injection from the respective second injection valves 18 from the aforementioned second old fuel fill-up value Y2MAX, which is correlated with the volume of the second supply path 24, sets the difference (=Y2MAX−Z2) as the estimated value Y2 of the amount of old fuel remaining in the second supply path 24 (step S32), and ends the present processing routine.

Next, a processing routine that is executed by the property determination unit 205 of the electronic control unit 100 to determine whether or not there is a deviation between the concentration of alcohol in the fuel in the first supply path 23 and the concentration of alcohol in the fuel in the second supply path 24 will be described with reference to a flowchart shown in FIG. 13.

Figure 13:
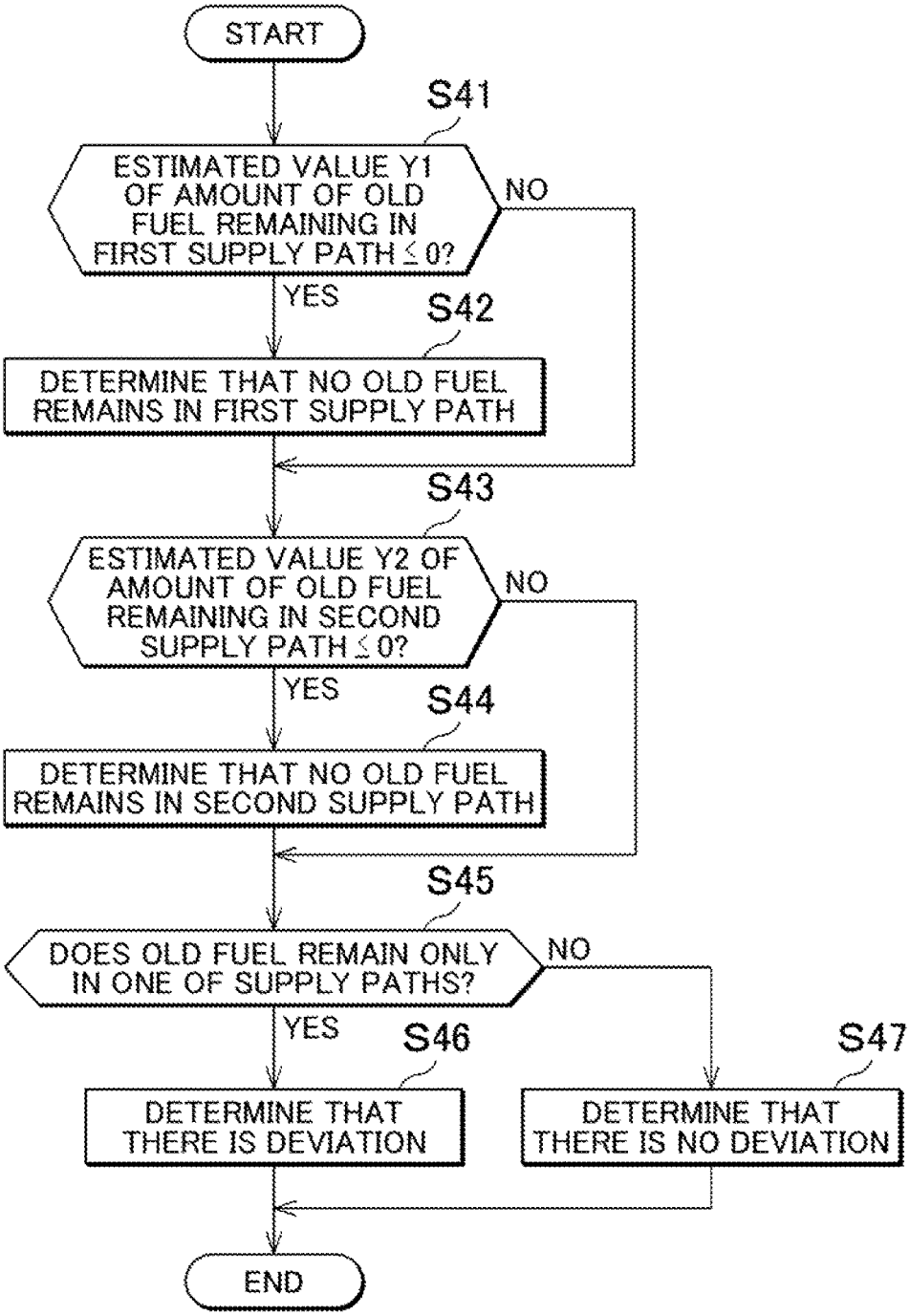
FIG. 13 is a flowchart showing a processing routine that is executed to determine whether there is a deviation between a concentration of alcohol in the fuel in the first supply path and a concentration of alcohol in the fuel in the second supply path in the control system.

As shown in FIG. 13, the property determination unit 205 determines whether or not the estimated value Y1 of the amount of old fuel remaining in the first supply path 23, which is calculated by the first calculation unit 203, is equal to or smaller than "0 (zero)" (step S41). When the estimated value Y of the remaining amount is equal to or smaller than "0 (zero)", it can be determined that no old fuel remains in the first supply path 23. When the estimated value Y1 of the remaining amount is larger than "0 (zero)", it can be determined that old fuel remains in the first supply path 23. Therefore, if the estimated value Y1 of the remaining amount is equal to or smaller than "0 (zero)" (YES in step S41), the property determination unit 205 determines that no old fuel remains in the first supply path 23 (step S42), and shifts its processing to subsequent step S43. On the other hand, if the estimated value Y1 of the remaining amount is larger than "0 (zero)" (NO in step S41), the property determination unit 205 shifts its processing to subsequent step S43 without executing the process of step S42.

In step S43, the property determination unit 205 determines whether or not the estimated value Y2 of the amount of old fuel remaining in the second supply path 24, which is calculated by the second calculation unit 204, is equal to or smaller than "0 (zero)". When the estimated value Y2 of the remaining amount is equal to or smaller than "0 (zero)", it can be determined that no old fuel remains in the second supply path 24. When the estimated value Y2 of the remaining amount is larger than "0 (zero)", it can be determined that old fuel remains in the second supply path 24. Therefore, if the estimated value Y2 of the remaining amount is equal to or smaller than "0 (zero)" (YES in step S43), the property determination unit 205 determines that no old fuel remains in the second supply path 24 (step S44), and shifts its processing to subsequent step S45. On the other hand, if the estimated value Y2 of the remaining amount is larger than "0 (zero)" (NO in step S43), the property determination unit 205 shifts its processing to subsequent step S45 without executing the process of step S44.

In step S45, the property determination unit 205 determines whether or not old fuel remains only in one of the first supply path 23 and the second supply path 24. That is, if old fuel remains in the first supply path 23 and no old fuel remains in the second supply path 24, and if old fuel remains in the second supply path 24 and no old fuel remains in the first supply path 23, the result of the determination in step S45 is affirmative. On the other hand, if old fuel remains in both the first supply path 23 and the second supply path 24, and if old fuel remains in neither the first supply path 23 nor the second supply path 24, the result of the determination in step S45 is negative.

Then, if the result of the determination in step S45 is affirmative (YES), the property determination unit 205 determines that there is a deviation between the concentration of alcohol in the fuel in the first supply path 23 and the concentration of alcohol in the fuel in the second supply path 24 (step S46), and ends the present processing routine. On the other hand, if the result of the determination in step S45 is negative (NO), the property determination unit 205 determines that there is no deviation between the concentration of alcohol in the fuel in the first supply path 23 and the concentration of alcohol in the fuel in the second supply path 24 (step S47), and ends the present processing routine.

Next, a processing routine that is executed by the injection control unit 201 of the electronic control unit 100 in controlling fuel injection by the first injection valves 17 and fuel injection by the second injection valves 18 will be described with reference to a flowchart shown in FIG. 14.

Figure 14:
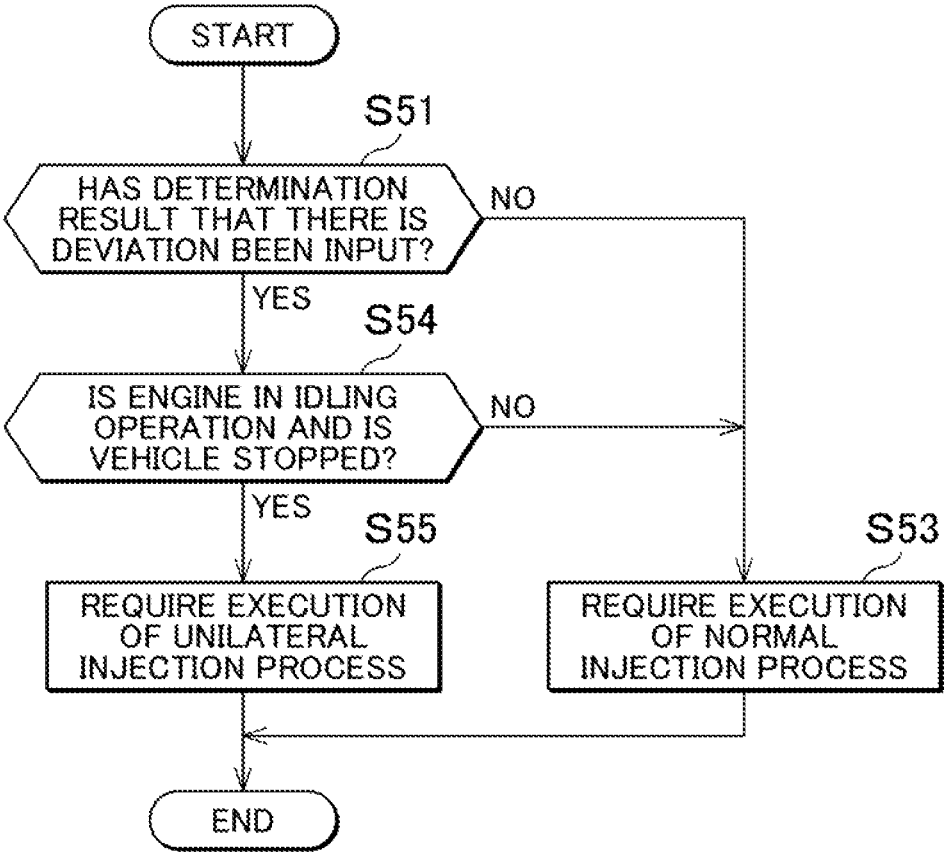
FIG. 14 is a flowchart showing a processing routine that is executed in controlling fuel injection by the first injection valves and fuel injection by the second injection valves in the control system.

As shown in FIG. 14, in the present processing routine, the injection control unit 201 determines whether or not a determination result that there is a deviation between the concentration of alcohol in the fuel in the first supply path 23 and the concentration of alcohol in the fuel in the second supply path 24 has been input to the injection control unit 201 from the property determination unit 205 (step S51). Then, if the determination result that there is a deviation between the concentration of alcohol in the fuel in the first supply path 23 and the concentration of alcohol in the fuel in the second supply path 24 has been input to the injection control unit 201 from the property determination unit 205 (YES in step S51), the injection control unit 201 shifts its processing to step S54, which will be described later.

On the other hand, if the determination result that there is a deviation between the concentration of alcohol in the fuel in the first supply path 23 and the concentration of alcohol in the fuel in the second supply path 24 has not been input to the injection control unit 201 from the property determination unit 205, a determination result that there is no deviation between the concentration of alcohol in the fuel in the first supply path 23 and the concentration of alcohol in the fuel in the second supply path 24 has been input to the injection control unit 201 from the property determination unit 205. Therefore, when the determination result that there is a deviation between the concentration of alcohol in the fuel in the first supply path 23 and the concentration of alcohol in the fuel in the second supply path 24 has not been input to the injection control unit 201 from the property determination unit 205 (NO in step S51), the injection control unit 201 shifts its processing to subsequent step S53.

In step S53, the injection control unit 201 requires the execution of a normal injection process. After that, the injection control unit 201 ends the present processing routine. In this case, the injection control unit 201 controls the first injection valves 17 and the second injection valves 18 based on the injection sharing ratio corresponding to the operating situation of the engine 11 at that time.

In step S54, the injection control unit 201 determines whether or not both the condition that the engine 11 is in idling operation and the condition that the vehicle is stopped are fulfilled. In concrete terms, it is determined whether or not the vehicle is stopped, depending on whether or not the vehicle speed VS detected by the vehicle speed sensor 11 is equal to or lower than a stop determination threshold. Then, if at least one of the condition that the engine 11 is in idling operation and the condition that the vehicle is stopped is not fulfilled (NO in step S54), the injection control unit 201 shifts its processing to the foregoing step S53. That is, even in the case where there is a deviation between the concentration of alcohol in the fuel in the first supply path 23 and the concentration of alcohol in the fuel in the second supply path 24, when the engine 11 is not in idling operation or when the vehicle is not stopped, the normal injection process is executed instead of the unilateral injection process.

On the other hand, if both the condition that the engine 11 is in idling operation and the condition that the vehicle is stopped are fulfilled (YES in step S54), the electronic control unit 100 requires the execution of the unilateral injection process (step S55), and temporarily ends the present processing routine.

Next, a processing routine that is executed by the injection control unit 201 of the electronic control unit 100 in requiring the execution of the unilateral injection process in the aforementioned processing routine shown in FIG. 14 will be described with reference to a flowchart shown in FIG. 15.

Figure 15:
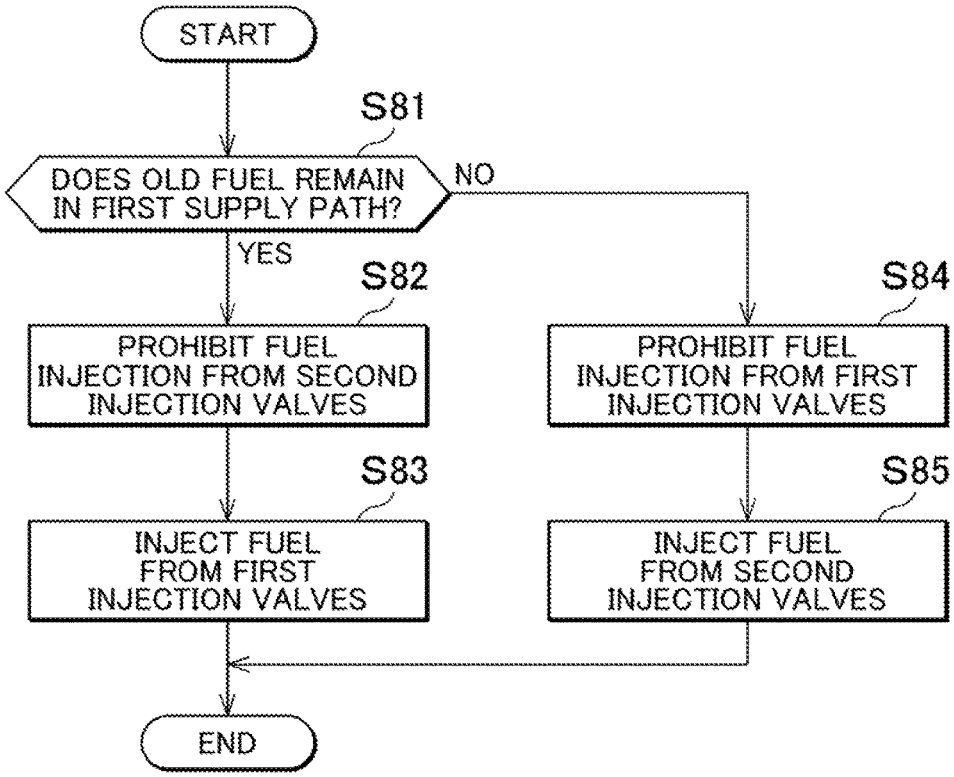
FIG. 15 is a flowchart showing a processing routine that is executed when the execution of a unilateral injection process is required in the control system.

As shown in FIG. 15, in the present processing routine, the injection control unit 201 determines whether or not old fuel remains in the first supply path 23 (step S81). If no old fuel remains in the first supply path 23, it can be determined that old fuel remains in the second supply path 24. Then, if old fuel remains in the first supply path (YES in step S81), the injection control unit 201 prohibits fuel injection from the second injection valves 18 (step S82), causes fuel to be injected from the first injection valves 17 (step S83), and then ends the present processing routine.

On the other hand, in step S81, if no old fuel remains in the first supply path 23 (NO in step S81), the injection control unit 201 prohibits fuel injection from the first injection valves 17 (step S84), causes fuel to be injected from the second injection valves 18 (step S85), and then ends the present processing routine.

Next, the operation of the engine 11 that is equipped with the electronic control unit 100 according to the present embodiment of the invention will be described. Incidentally, as a premise, the concentration of alcohol in the fuel in the fuel tank 21 is assumed to have changed through refueling.

Immediately after a change in the concentration of alcohol in the fuel in the fuel tank 21, new fuel has not flowed into the first supply path 23 and the second supply path 24 yet, so old fuel still remains in both the first supply path 23 and the second supply path 24 (NO in step S51). Therefore, the normal injection process is executed for a while immediately after the change in the concentration of alcohol in the fuel in the fuel tank 21. Thus, even when either the first injection valves 17 or the second injection valves 18 are driven, old fuel is injected from the injection valves (step S53). In this case, there is no deviation between the concentration of alcohol in the fuel injected from the first injection valves 17 and the concentration of alcohol in the fuel injected from the second injection valves 18, so the combustion characteristics of the air-fuel mixture in the cylinders 12 do not deteriorate.

When new fuel reaches the downstream end 22A in the common path 22 after a while, this new fuel then flows into the first supply path 23 and the second supply path 24. Then, the old fuel in the first supply path 23 disappears prior to the old fuel in the second supply path 24 (YES in step S51), there is a deviation between the concentration of alcohol in the fuel injected from the first injection valves 17 and the concentration of alcohol in the fuel injected from the second injection valves 18 until the old fuel in the second supply path 24 disappears. On the contrary, even if the old fuel in the second supply path 24 disappears prior to the old fuel in the first supply path 23 (YES in step S51), there is a deviation between the concentration of alcohol in the fuel injected from the first injection valves 17 and the concentration of alcohol in the fuel injected from the second injection valves 18, until the old fuel in the first supply path 23 disappears.

Even under such a situation, if the engine 11 is not in idling operation or if the vehicle is not stopped (NO in step S54), the normal injection process is executed instead of the unilateral injection process (step S53). However, if the vehicle is stopped and idling operation of the engine 11 is performed under such a situation (YES in step S54), the unilateral injection process is executed (step S55).

If old fuel still remains in the first supply path 23 (YES in step S81), the first supply path 23 is equivalent to the specific supply path, and each of the first injection valves 17 is equivalent to the specific injection valve. Therefore, in the unilateral injection process in this case, while fuel is injected from the first injection valves 17, no fuel is injected from the second injection valves 18 (steps S82 and S83). On the contrary, if old fuel still remains in the second supply path 24 (NO in step S81), the second supply path 24 is equivalent to the specific supply path, and each of the second injection valves 18 is equivalent to the specific injection valve. Therefore, in the unilateral injection process in this case, while fuel is injected from the second injection valves 18, no fuel is injected from the first injection valves 17 (steps S84 and S85). That is, even at the time of idling operation when only port injection is intrinsically carried out, only in-cylinder injection may be carried out without carrying out port injection (see FIG. 2). Incidentally, the diagnosis processes and learning processes that are accompanied by both port injection and in-cylinder injection are not executed during a period in which the unilateral injection process is thus executed.

When old fuel disappears soon afterward from the interior of the specific supply path through which fuel is supplied to the injection valves injecting fuel (the specific injection valves) through the execution of the unilateral injection process, there is no deviation between the concentration of alcohol in the fuel in the first supply path 23 and the concentration of alcohol in the fuel in the second supply path 24 (NO in step S51). Therefore, the execution of the unilateral injection process is ended, and the normal injection process is executed (step S53). That is, the prohibition of fuel injection from the injection valves that are different from the specific injection valves is canceled.

Incidentally, if the operation of the engine 11 becomes different from idling operation or the vehicle starts running during the execution of the unilateral injection process (NO in step S54), the execution of the unilateral injection process is ended, and the normal injection process is executed (step S53).

As described above, the following effects can be obtained according to the aforementioned configuration and operation. (1) When there is a deviation between the concentration of alcohol in the fuel injected from the first injection valves 17 and the concentration of alcohol in the fuel injected from the second injection valves 18, the electronic control unit 100 executes the unilateral injection process. During the execution of the unilateral injection process, while fuel is injected from either the first injection valves 17 or the second injection valves 18, no fuel is injected from the other injection valves. Therefore, the phenomenon that fuels with different concentrations of alcohol are supplied into the same cylinder 12 from the separate injection valves does not occur. Accordingly, the combustion characteristics of the air-fuel mixture in the cylinders 12 can be restrained from deteriorating as a result of a deviation between the concentration of alcohol in the fuel injected from the first injection valves 17 and the concentration of alcohol in the fuel injected from the second injection valves 18.

(2) The condition for executing the unilateral injection process includes that the engine 11 is in idling operation. Therefore, when the engine 11 is in idling operation, the combustion characteristics of the air-fuel mixture in the cylinders 12 are restrained from deteriorating, through the execution of the unilateral injection process, so the occurrence of the phenomenon that the operating state of the engine 11 is destabilized can be suppressed. On the other hand, when the engine 11 is not in idling operation, the operating state of the engine 11 is unlikely to be destabilized by a deterioration in the combustion characteristics of the air-fuel mixture, so the unilateral injection process is not executed. Therefore, the unilateral injection process can be restrained from being executed unnecessarily.

(3) Besides, the condition for executing the unilateral injection process includes that the vehicle is stopped. Therefore, especially during stop of the vehicle when the passenger is likely to feel uncomfortable with the noise or vibration that occurs in the engine 11 as a result of a deterioration in the combustion characteristics of the air-fuel mixture, the combustion characteristics of the air-fuel mixture can be restrained from deteriorating, by executing the unilateral injection process. By thus executing the unilateral injection process during stop of the vehicle, the passenger can be made unlikely to feel uncomfortable. On the other hand, at the time of the running of the vehicle when the passenger is unlikely to feel uncomfortable even if noise or vibration occurs as a result of a deterioration in the combustion characteristics of the air-fuel mixture, the unilateral injection process is not executed. Therefore, the unilateral injection process can be restrained from being executed unnecessarily.

Besides, in the electronic control unit 100 according to the present embodiment of the invention, on the condition that it is determined that new fuel has reached the downstream end 22A of the common path 22, it is determined whether or not there is a deviation between the concentration of alcohol in the fuel in the first supply path 23 and the concentration of alcohol in the fuel in the second supply path 24. That is, the electronic control unit 100 can execute the unilateral injection process when the fuel (new fuel) with the concentration of alcohol that is different from that of the fuel (old fuel) stored in the fuel supply system 20 earlier has flowed into the common path 22 from the fuel tank 21 and there may be a deviation between the concentration of alcohol in the fuel in the first supply path 23 and the concentration of alcohol in the fuel in the second supply path 24. On the other hand, when the inflow of the fuel (new fuel) with the concentration of alcohol that is different from that of the fuel (old fuel) stored in the fuel supply system 20 earlier into the common path 22 is not detected, there is no deviation between the concentration of alcohol in the fuel injected from the first injection valves 17 and the concentration of alcohol in the fuel injected from the second injection valves 18, so the electronic control unit 100 does not execute the unilateral injection process. Therefore, the unilateral injection process can be restrained from being executed unnecessarily.

(5) In the unilateral injection process, fuel is injected only from the specific injection valves that inject the fuel in the specific supply path in which old fuel still remains. Therefore, old fuel can be removed from the interior of the specific supply path, and a situation where the interior of the specific supply path is filled with new fuel can be created at an early stage. That is, the unilateral injection process can be ended at an early stage. As a result, fuel injection control in which both the first injection valves 17 and the second injection valves 18 are used can be performed at an early stage. That is, the aforementioned various learning processes and diagnosis processes can be executed at an early stage.

(6) In the electronic control unit 100 according to the present embodiment of the invention, even in the case where refueling is carried out, when the concentration of alcohol in fuel in the fuel tank 21 is approximately equal to the concentration of alcohol in the fuel stored in the fuel supply system 20 before refueling, the unilateral injection process is not executed. Accordingly, the unilateral injection process can be restrained from being executed unnecessarily.

(7) When there is a deviation between the concentration of alcohol in the fuel in the first supply path 23 and the concentration of alcohol in the fuel in the second supply path 24, the air-fuel ratio of the exhaust gas flowing through the exhaust passage 14 may change due to a change in the aforementioned injection sharing ratio. Therefore, it can also be determined whether or not there is a deviation between the concentration of alcohol in the fuel in the first supply path 23 and the concentration of alcohol in the fuel in the second supply path 24, by monitoring the air-fuel ratio of exhaust gas when the aforementioned injection sharing ratio is changed. In this case, however, the combustion characteristics of the air-fuel mixture in the cylinders 12 deteriorate until it can be determined that there is a deviation between the concentration of alcohol in the fuel in the first supply path 23 and the concentration of alcohol in the fuel in the second supply path 24. In contrast, in the present embodiment of the invention, it is determined whether or not there is a deviation between the concentration of alcohol in the fuel in the first supply path 23 and the concentration of alcohol in the fuel in the second supply path 24, based on the amount of old fuel remaining in the first supply path 23 and the amount of old fuel remaining in the second supply path 24. Therefore, this determination can be made without causing a deterioration in the combustion characteristics of the air-fuel mixture in the cylinders 12 resulting from a deviation between the concentration of alcohol in the fuel in the first supply path 23 and the concentration of alcohol in the fuel in the second supply path 24.

Next, a control system for an engine according to the second embodiment of the invention will be described with reference to FIGS. 16 and 17. In the control system according to the present embodiment of the invention, the definition of old fuel and new fuel, the condition for determining whether or not there is a deviation between the concentration of alcohol in the fuel in the first supply path 23 and the concentration of alcohol in the fuel in the second supply path 24, and the like are different from those of the first embodiment of the invention. Accordingly, in the following description, what is different from the first embodiment of the invention will be mainly described. Component members identical or equivalent to those of the first embodiment of the invention are denoted by the same reference symbols respectively, and redundant description will be omitted.

Figure 16:
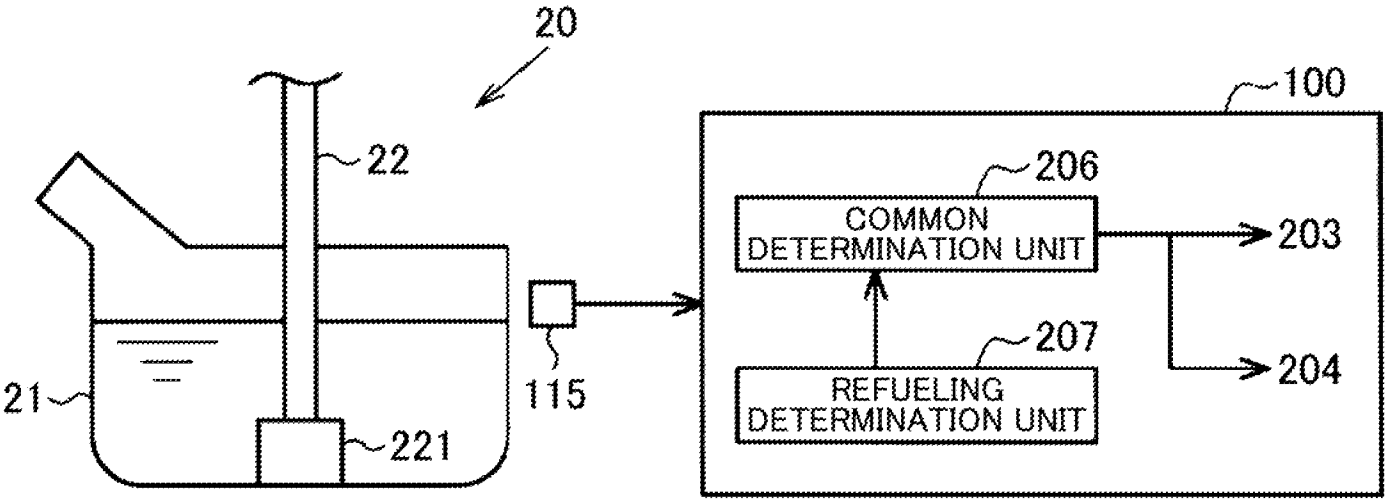
FIG. 16 is a configuration view showing the outline of a part of a fuel supply system and peripheral members thereof and a part of the functional configuration of a control system according to the second embodiment of the invention, in the control system.

As shown in FIG. 16, the engine 11 that is equipped with the electronic control unit 100 according to the present embodiment of the invention is provided with a storage amount detection sensor 115 that detects an amount of fuel stored in the fuel tank 21. Therefore, the electronic control unit 100 can determine that there may be a deviation between the concentration of alcohol in the fuel stored in the fuel supply system 20 and the concentration of alcohol in the fuel in the fuel tank 21, by monitoring the storage amount of fuel detected by the storage amount detection sensor 115. Thus, in the present embodiment of the invention, in the case where the amount of the fuel stored in the fuel tank 21 has increased, the fuel stored in the fuel supply system 20 before the increase in the amount of the fuel stored in the fuel tank 21 is referred to as "old fuel", and the fuel in the fuel tank 21 is referred to as "new fuel".

It should be noted in this case, however, that new fuel is not caused to flow into the first supply path 23 and the second supply path 24 until old fuel disappears from the interior of the common path 22 and the interior of the common path 22 is filled with new fuel, even after an increase in the amount of the fuel stored in the fuel tank 21 is detected, namely, even after it is determined that there may be a deviation between the concentration of alcohol in the fuel stored in the fuel supply system 20 and the concentration of alcohol in the fuel in the fuel tank 21. Accordingly, in the electronic control unit 100 according to the present embodiment of the invention, when an increase in the amount of the fuel stored in the fuel tank 21 is detected, it can be determined that refueling has been carried out. Therefore, it is determined whether or not old fuel remains in the common path 22. Then, if it is determined that no old fuel remains in the common path 22, the calculation of the estimated value Y1 of the amount of old fuel remaining in the first supply path 23 and the calculation of the estimated value Y2 of the amount of old fuel remaining in the second supply path 24 are carried out.

That is, as shown in FIG. 16, the electronic control unit 100 has a refueling determination unit 207 and a common determination unit 206 in addition to the injection control unit 201, the first calculation unit 203, the second calculation unit 204 and the property determination unit 205, as functional units that are constituted by at least one of software and hardware.

When the amount of fuel stored in the fuel tank 21 increases, the refueling determination unit 207 determines, based on a result of detection by the storage amount detection sensor 115, that refueling has been carried out. In concrete terms, when the difference between the amount of fuel stored at a time point when the operation of the engine 11 is stopped and the amount of fuel stored at a time point when the operation of the engine 11 is started afterward is larger than a determination difference, the refueling determination unit 207 determines that refueling has been carried out. Then, upon determining that refueling has been carried out, the refueling determination unit 207 outputs this information to the common determination unit 206.

The common determination unit 206 determines whether or not old fuel remains in the common path 22, based on the volume of the common path 22 and the total amount of fuel injection from the respective injection valves 17 and 18 after the information that refueling has been carried out is input to the common determination unit 206 from the refueling determination unit 207. Then, upon determining that no old fuel remains in the common path 22, the common determination unit 206 outputs this information to the first calculation unit 203 and the second calculation unit 204.

When the information that no old fuel remains in the common path 22 is input to the first calculation unit 203 from the common determination unit 206, the first calculation unit 203 starts calculating the estimated value Y1 of the amount of old fuel remaining in the first supply path 23. In this case, the first calculation unit 203 acquires a total amount of fuel injection by the first injection valves 17 after the information that no old fuel remains in the common path 22 is input to the first calculation unit 203. Then, the first calculation unit 203 subtracts the total amount of fuel injection by the first injection valves 17 from the first old fuel fill-up value, and sets the difference as the estimated value Y1 of the amount of old fuel remaining in the first supply path 23.

When the information that no old fuel remains in the common path 22 is input to the second calculation unit 204 from the common determination unit 206, the second calculation unit 204 starts calculating the estimated value Y2 of the amount of old fuel remaining in the second supply path 24. In this case, the second calculation unit 204 acquires a total amount of fuel injection by the second injection valves 18 after the information that no old fuel remains in the common path 22 is input to the second calculation unit 204. Then, the second calculation unit 204 subtracts the total amount of fuel injection by the second injection valves 18 from the second old fuel fill-up value, and sets the difference as the estimated value Y2 of the amount of old fuel remaining in the second supply path 24.

Next, a processing routine that is executed by the common determination unit 206 of the electronic control unit 100 to determine that no old fuel remains in the common path 22 will be described with reference to a flowchart shown in FIG. 17.

Figure 17:
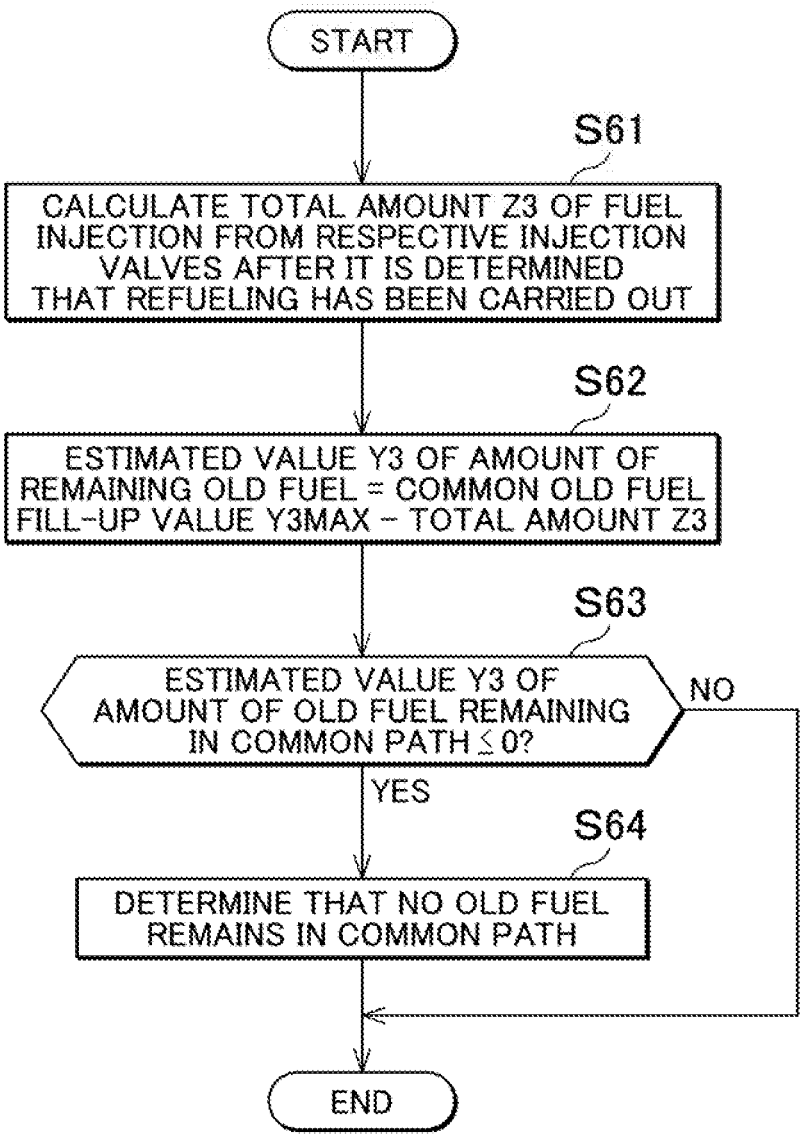
FIG. 17 is a flowchart showing a processing routine that is executed to determine whether old fuel remains in the common path in the control system.

As shown in FIG. 17, the common determination unit 206 calculates a total amount Z3 of fuel injection from the respective injection valves 17 and 18 after the refueling determination unit 207 determines that refueling has been carried out (step S61). Then, the common determination unit 206 calculates an estimated value Y3 of the amount of old fuel remaining in the common path 22 (step S62). That is, the volume of the common path 22 is a value that can be grasped in advance. Therefore, when the interior of the common path 22 is filled with old fuel, the amount of old fuel in the common path 22 can also be grasped. Then, in the case where the amount of old fuel remaining in the common path 22 at the time when the interior of the common path 22 is filled with old fuel is assumed to be "a common old fuel fill-up value Y3MAX", the common determination unit 206 subtracts the total amount Z3 calculated in step S61 from the common old fuel fill-up value Y3MAX, and sets the difference as the estimated value Y3 of the amount of old fuel remaining in the common path 22.

Subsequently, the common determination unit 206 determines whether or not the calculated estimated value Y3 of the amount of remaining old fuel is equal to or smaller than "0 (zero)" (step S63). When the estimated value Y3 of the remaining amount is equal to or smaller than "0 (zero)", it can be determined that no old fuel remains in the common path 22. Therefore, if the estimated value Y3 of the remaining amount is equal to or smaller than "0 (zero)" (YES in step S63), the common determination unit 206 determines that no old fuel remains in the common path 22 (step S64), and ends the present processing routine. On the other hand, if the estimated value Y3 of the remaining amount is larger than "0 (zero)" (NO in step S63), the common determination unit 206 ends the present processing routine without executing the process of step S64.

Next, the operation of the engine 11 that is equipped with the electronic control unit 100 according to the present embodiment of the invention will be described. Even when the amount of fuel stored in the fuel tank 21 increases through refueling, old fuel still remains in the common path 22 and in both the first supply path 23 and the second supply path 24 immediately thereafter. Therefore, the electronic control unit 100 executes the normal injection process for a while even after refueling. In this case, regardless of whether the first injection valves 17 or the second injection valves 18 are driven, old fuel is injected from the injection valves. Thus, when old fuel is injected from at least either the respective injection valves 17 or the respective injection valves 18, new fuel flows into the common path 22 from the interior of the fuel tank 21.

After that, when old fuel disappears from the interior of the common path 22 through fuel injection by at least either the respective injection valves 17 or the respective injection valves 18 (step S64) and the interior of the common path 22 is filled with new fuel, fuel injection is carried out from the first injection valves 17, so new fuel flows into the first supply path 23. Besides, fuel injection is carried out from the second injection valves 18, so new fuel flows into the second supply path 24.

Then, when the old fuel in the first supply path 23 disappears prior to the old fuel in the second supply path 24, there may be a deviation between the concentration of alcohol in the fuel injected from the first injection valves 17 and the concentration of alcohol in the fuel injected from the second injection valves 18 until the old fuel in the second supply path 24 disappears. On the contrary, even when the old fuel in the second supply path 24 disappears prior to the old fuel in the first supply path 23, there may be a deviation between the concentration of alcohol in the fuel injected from the first injection valves 17 and the concentration of alcohol in the fuel injected from the second injection valves 18 until the old fuel in the first supply path 23 disappears.

Even under such a situation, when the engine 11 is not in idling operation or when the vehicle is not stopped, the normal injection process is executed instead of the unilateral injection process. However, when both the condition that the engine 11 is in idling operation and the condition that the vehicle is stopped are fulfilled under the situation where there may be a deviation between the concentration of alcohol in the fuel injected from the first injection valves 17 and the concentration of alcohol in the fuel injected from the second injection valves 18, the unilateral injection process is executed. In the unilateral injection process that is executed when old fuel still remains in the first supply path 23, the first supply path 23 is equivalent to the specific supply path, and each of the first injection valves 17 is equivalent to the specific injection valve. Therefore, while fuel is injected from the first injection valves 17, fuel injection from the second injection valves 18 is prohibited. On the contrary, in the unilateral injection process that is executed when old fuel still remains in the second supply path 24, the second supply path 24 is equivalent to the specific supply path, and each of the second injection valves 18 is equivalent to the specific injection valve. Therefore, while fuel is injected from the second injection valves 18, fuel injection from the first injection valves 17 is prohibited.

Incidentally, when old fuel disappears from the interior of the specific supply path from which fuel is supplied to each of the injection valves that injects fuel (the specific injection valve) through the execution of the unilateral injection process, there is no deviation between the concentration of alcohol in the fuel in the first supply path 23 and the concentration of alcohol in the fuel in the second supply path 24. Therefore, the execution of the unilateral injection process is ended, and the normal injection process is executed. That is, the prohibition of fuel injection from each of the injection valves that is different from the specific injection valve is canceled.

As described above, according to the aforementioned configuration and operation, the following effects can further be obtained in addition to effects equivalent to those (2), (3), (5) and (7) of the aforementioned embodiment of the invention. (8) When there may be a deviation between the concentration of alcohol in the fuel injected from the first injection valves 17 and the concentration of alcohol in the fuel injected from the second injection valves 18, the unilateral injection process is executed. During the execution of the unilateral injection process, while fuel is injected from either the first injection valves 17 or the second injection valves 18, no fuel is injected from the other injection valves. Therefore, the phenomenon that fuels with different concentrations of alcohol are supplied into the same cylinder 12 from the separate injection valves does not occur. Accordingly, the combustion characteristics of the air-fuel mixture in the cylinders 12 can be restrained from deteriorating as a result of a deviation between the concentration of alcohol in the fuel injected from the first injection valves 17 and the concentration of alcohol in the fuel injected from the second injection valves 18.

(9) In the electronic control unit 100 according to the present embodiment of the invention, when the amount of fuel stored in the fuel tank 21 is increased, it is determined that refueling has been carried out. Then, after it is thus determined that refueling has been carried out, it is determined whether or not there may be a deviation between the concentration of alcohol in the fuel in the first supply path 23 and the concentration of alcohol in the fuel in the second supply path 24 after it is determined that old fuel has disappeared from the interior of the common path 22. On the other hand, when no increase in the amount of fuel stored in the fuel tank 21 is detected, it is not determined that refueling has been carried out. Thus, when refueling is not carried out, there is no deviation between the concentration of alcohol in the fuel in the first supply path 23 and the concentration of alcohol in the fuel in the second supply path 24, so the unilateral injection process is not executed. Accordingly, the unilateral injection process can be restrained from being executed unnecessarily.

Incidentally, each of the aforementioned embodiments of the invention may be changed into other embodiments of the invention as will be described below. In each of the aforementioned embodiments of the invention, the amount of old fuel remaining in the first supply path 23 and the amount of old fuel remaining in the second supply path 24 are computed through estimation, and it is determined based on the result of this estimation whether or not old fuel remains in the supply path. However, the amount of new fuel flowing into the supply path may be computed through estimation instead of the amount of old fuel remaining in the supply path, and it may be determined based on the result of this estimation whether or not old fuel remains in the supply path.

That is, when the estimated value of the amount of new fuel flowing into the first supply path 23 is calculated, the total amount Z1 of fuel injected from the respective first injection valves 17 after the disappearance of old fuel from the interior of the common path 22 is the estimated value of the amount of new fuel flowing into the first supply path 23. Then, when this estimated value of the inflow amount of new fuel is equal to or larger than the aforementioned first old fuel fill-up value Y1MAX, it can be determined that no old fuel remains in the first supply path 23.

By the same token, when the estimated value of the amount of new fuel flowing into the second supply path 24 is calculated, the total amount Z2 of fuel injected from the respective second injection valves 18 after the disappearance of old fuel from the interior of the common path 22 is the estimated value of the amount of new fuel flowing into the second supply path 24. Then, when this estimated value of the inflow amount of new fuel is equal to or larger than the aforementioned second old fuel fill-up value Y2MAX, it can be determined that no old fuel remains in the second supply path 24.

Besides, in the second embodiment of the invention, the total amount Z3 of fuel injected from the respective injection valves 17 and 18 after it is determined that refueling has been carried out is the estimated value of the amount of new fuel flowing into the common path 22. Then, when this estimated value of the inflow amount of new fuel is equal to or larger than the aforementioned common old fuel fill-up value Y3MAX, it can be determined that no old fuel remains in the common path 22.

In each of the aforementioned embodiments of the invention, the amount of old fuel remaining in the first supply path 23 and the amount of old fuel remaining in the second supply path 24 are computed through estimation, and it is determined based on the result of this estimation whether or not there is a deviation between the concentration of alcohol in the fuel in the first supply path 23 and the concentration of alcohol in the fuel in the second supply path 24. However, this determination may be made according to another method that is different from the method in which the estimated values Y and Y2 of the amounts of old fuel remaining in the respective supply paths are used.

Figure 18:
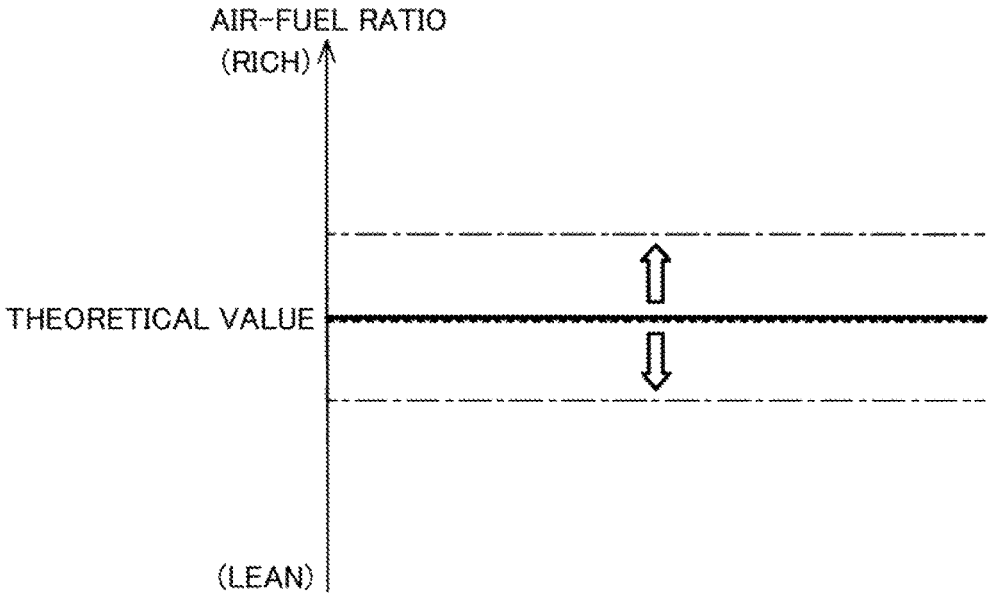
FIG. 18 is a view explaining a case where it is determined from an air-fuel ratio whether there is a deviation between a concentration of alcohol in fuel in a first supply path and a concentration of alcohol in fuel in a second supply path, in a control system according to another embodiment of the invention.

For example, under the situation where there is no deviation between the concentration of alcohol in the fuel injected from the first injection valves 17 and the concentration of alcohol in the fuel injected from the second injection valves 18, the air-fuel ratio that is calculated based on the detection result from the air-fuel ratio sensor 113 substantially coincides with a theoretical value, namely, a required value of the air-fuel ratio regardless of the aforementioned injection sharing ratio. However, when the concentration of alcohol in the fuel injected from the first injection valves 17 and the concentration of alcohol in the fuel injected from the second injection valves 18 deviate from each other, the air-fuel ratio changes depending on the aforementioned injection sharing ratio as shown in FIG. 18.

That is, the concentration of alcohol in the fuel injected from the first injection valves 17 is assumed to be lower than the concentration of alcohol in the fuel injected from the second injection valves 18. In this case, when the injection sharing ratio becomes large and the amount of fuel injected from the first injection valves 17 becomes large, the air-fuel ratio changes toward the rich side. On the other hand, when the injection sharing ratio becomes small and the amount of fuel injected from the first injection valves 17 becomes small, the air-fuel ratio changes toward the lean side.

Therefore, when a change in the air-fuel ratio is thus detected in accordance with a change in the injection sharing ratio, it may be determined that there is a deviation between the concentration of alcohol in the fuel injected from the first injection valves 17 and the concentration of alcohol in the fuel injected from the second injection valves 18. The determination method in which the air-fuel ratio is used in this manner can also be adopted in a control system applied to an engine that is not equipped with the property detection sensor 114 and the storage amount detection sensor 115.

Figure 19:
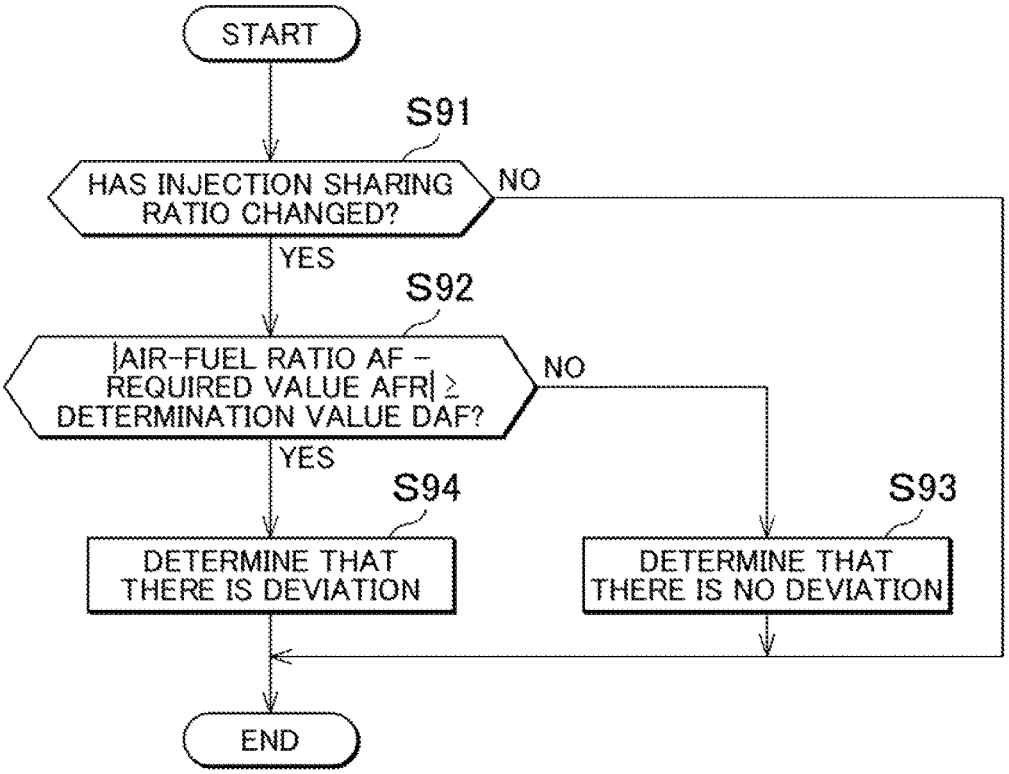
FIG. 19 is a flowchart showing a processing routine that is executed to determine from the air-fuel ratio whether there is a deviation between the concentration of alcohol in the fuel in the first supply path and the concentration of alcohol in the fuel in the second supply path, in the control system according to the embodiment of the invention.

FIG. 19 explains an exemplary processing routine that is executed by the property determination unit 205 to determine whether or not there is a deviation between the concentration of alcohol in the fuel in the first supply path 23 and the concentration of alcohol in the fuel in the second supply path 24 due to a change in an air-fuel ratio AF resulting from a change in the injection sharing ratio.

As shown in FIG. 19, the property determination unit 205 determines whether or not the injection sharing ratio has changed (step S91). If the injection sharing ratio has not changed (NO in step S91), the property determination unit 205 ends the present processing routine. On the other hand, if the injection sharing ratio has changed (YES in step S91), the property determination unit 205 obtains a difference (=|AF−AFR|) between the air-fuel ratio AF of exhaust gas estimated based on the detection result of the air-fuel ratio sensor 113 and a required value AFR of the air-fuel ratio, and determines whether or not this difference is equal to or larger than a determination value DAF (step S92). This determination value DAF is a value set to determine whether or not the air-fuel ratio AF has changed due to a change in the injection sharing ratio. If the difference is smaller than the determination value DAF (NO in step S92), the property determination unit 205 determines that there is no deviation between the concentration of alcohol in the fuel in the first supply path 23 and the concentration of alcohol in the fuel in the second supply path 24 (step S93), and ends the present processing routine. On the other hand, if the difference is equal to or larger than the determination value DAF (YES in step S92), the property determination unit 205 determines that there is a deviation between the concentration of alcohol in the fuel in the first supply path 23 and the concentration of alcohol in the fuel in the second supply path 24 (step S94), and ends the present processing routine.

In the first embodiment of the invention, the position of detection by the property detection sensor 114 may be set upstream of the downstream end 22A as long as the concentration of alcohol in the fuel in the common path 22 can be detected by the property detection sensor 114.

In the second embodiment of the invention, the property detection sensor 114 may be arranged in the fuel tank 21 instead of the storage amount detection sensor 115. In this case, when a change in the concentration of alcohol in the fuel stored in the fuel tank 21 is detected, it can be determined that there is a deviation between the concentration of alcohol in the fuel stored in the fuel supply system 20 and the concentration of alcohol in the fuel in the fuel tank 21. Then, when this information is input to the common determination unit 206, the calculation of the amount of old fuel remaining in the common path 22 or the amount of new fuel flowing there into is carried out. In this configuration, in the case where the concentration of alcohol in the fuel in the fuel tank 21 hardly changes even when refueling is carried out, it is not determined that there is a deviation between the concentration of alcohol in the fuel stored in the fuel supply system 20 and the concentration of alcohol in the fuel in the fuel tank 21.

In the second embodiment of the invention, in the case where the vehicle is provided with an operation portion that is operated by the passenger of the vehicle at the time of refueling, it may be determined that refueling has been carried out when an operation of the operation portion is detected.

In the case where the vehicle is a hybrid vehicle that is equipped with a motive power source other than the engine 11, if the engine 11 is in idling operation, the unilateral injection process may be executed even during the running of the vehicle.

Even when the engine 11 is not in idling operation or while the vehicle runs, the unilateral injection process may be executed. It should be noted, however, that if fuel injection from either the first injection valves 17 or the second injection valves 18 is prohibited in the case where the operating range of the engine 11 is a high-rotation high-load operating range, the amount of fuel supplied into the cylinders 12 may not reach a required amount, as described using FIG. 2. Therefore, when the engine 11 is in operation in this high-rotation high-load operating range, the execution of the unilateral injection process needs to be prohibited.

Incidentally, in the case where the unilateral injection process is executed even when the engine 11 is not in idling operation, the injection valves by which fuel is injected may be determined in accordance with the operating state of the engine 11. For example, in the unilateral injection process under the situation where the engine 11 is in operation in the operating range where only port injection is carried out, fuel may be caused to be injected from the first injection valves 17, and fuel injection from the second injection valves 18 may be prohibited. Besides, in the unilateral injection process under the situation where the engine 11 is in operation in the operating range where only in-cylinder injection is carried out, fuel may be caused to be injected from the second injection valves 18, and fuel injection from the first injection valves 17 may be prohibited.

Besides, in the unilateral injection process under the situation where the engine 11 is in operation in the operating range where both port injection and in-cylinder injection are carried out, the injection valves by which fuel is injected may be determined based on the injection sharing ratio at that time. For example, when the injection sharing ratio is equal to or larger than "0.5", fuel may be caused to injected from the first injection valves 17, and fuel injection from the second injection valves 18 may be prohibited. On the other hand, when the injection sharing ratio is smaller than "0.5", fuel may be caused to be injected from the second injection valves 18, and fuel injection from the first injection valves 17 may be prohibited.

In the unilateral injection process, fuel may be caused to be injected from the injection valves that are supplied with fuel from that one of the first supply path 23 and the second supply path 24 in which no old fuel remains already, and fuel injection by the injection valves that are supplied with fuel from the supply path in which old fuel still remains may be prohibited.

In each of the aforementioned embodiments of the invention, the example in which the control system is applied to the engine 11 that is provided, for each of the cylinders 12, with the injection valve that injects fuel into the intake passage 13 and the injection valve that directly injects fuel into the cylinder 12 has been described. However, the electronic control unit may be applied to another engine as long as this engine is equipped with a plurality of injection valves that can supply fuel into the same cylinder 12.

Figure 20:
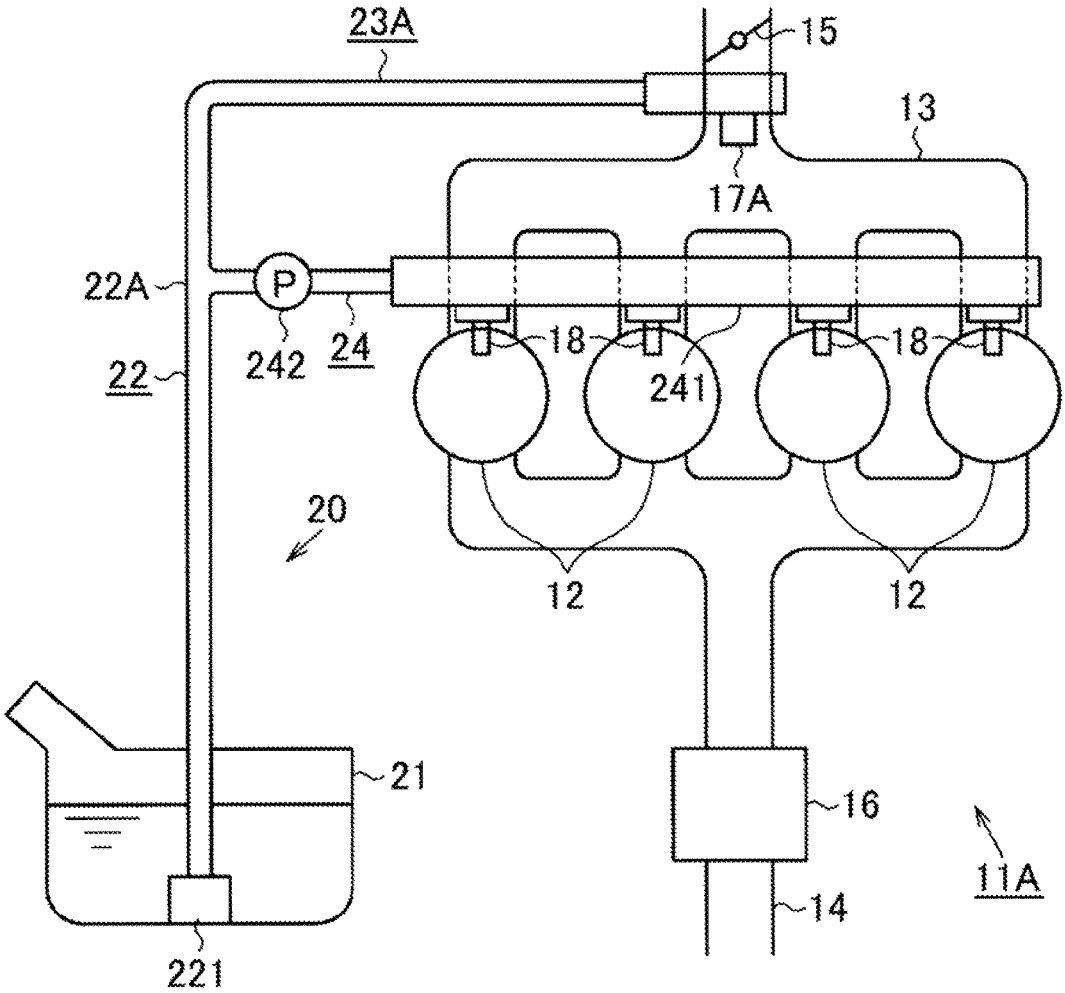
FIG. 20 is a configuration view showing the outline of an engine, in a control system according to still another embodiment of the invention.

For example, the control system may be applied to an engine 11A shown in FIG. 20. That is, as shown in FIG. 20, the engine 11A is equipped with the second injection valves 18 that directly inject fuel into the cylinders 12, and a first injection valve 17A that supplies fuel into the intake passage 13. While the second injection valves 18 are provided for the cylinders 12 respectively, only the single first injection valve 17A is provided. This first injection valve 17A is arranged on the throttle valve 15 side with respect to a branch point of the intake passage 13 that branches off into the respective cylinders 12. Therefore, the fuel injected from this first injection valve 17A is supplied into the respective cylinders 12 through the interior of the intake passage 13.

The fuel supply system 20 of this engine 11A is equipped with the second supply path 24 and a first supply path 23A that are connected to the downstream end 22A of the common path 22. Moreover, the fuel supplied from the first supply path 23A is injected into the intake passage 13 by the first injection valve 17A.

With this configuration as well, when there is a deviation between the concentration of alcohol in the fuel in the second supply path 24 and the concentration of alcohol in the fuel in the first supply path 23A, fuels with different concentrations of alcohol are supplied into the cylinders 12 from the separate injection valves, so the combustion characteristics of the air-fuel mixture may deteriorate. Therefore, when there is or may be a deviation between the concentration of alcohol in the fuel in the second supply path 24 and the concentration of alcohol in the fuel in the first supply path 23A, the combustion characteristics of the air-fuel mixture in the cylinders 12 can be restrained from deteriorating, by executing the unilateral injection process.

In each of the aforementioned embodiments of the invention, the control system that is applied to the engine 11 in which alcohol-mixed fuel can be used has been described. However, the use of alcohol-mixed fuel is impossible in some engines. In the control system that is applied to these engines, it may be detected or estimated whether fuel is heavy or light, and the unilateral injection process may be executed if necessary. That is, in the case where the fuel used in each of these engines is gasoline, a selection of heavy fuel or light fuel may be made on a refueling facility side, in accordance with the season or the like. Therefore, with one of heavy fuel and light fuel stored in the fuel supply system 20, the other fuel may be newly supplied into the fuel tank 21. In this case, there is a deviation between the property of old fuel and the property of new fuel. Therefore, when one of old fuel and new fuel is injected from the first injection valves 17 and the other fuel is injected from the second injection valves 18, the combustion characteristics of the air-fuel mixture in the cylinders 12 change. Accordingly, when it can be determined that the fuel in one of the first supply path 23 and the second supply path 24 is heavy fuel and that the fuel in the other supply path is light fuel, the unilateral injection process may be executed.

The aforementioned control system for the engine may be applied to an engine that is operated through the use of other fuels except gasoline and alcohol-mixed fuel, as long as the combustion characteristics of the air-fuel mixture in the cylinders 12 may change through injection of fuels with different properties from separate injection valves in the engine.

What is claimed is:

1. A control system comprising:

an engine including a first injection valve and a second injection valve that are configured to supply fuel into a same cylinder of the engine, a fuel supply system including a first supply path that is configured to supply fuel in a fuel tank to the first injection valve, and a second supply path that is configured to supply fuel in the fuel tank to the second injection valve; and an electronic control unit that is configured to i) control fuel injection from the first injection valve and fuel injection from the second injection valve in accordance with an operating state of the engine, ii) determine whether there is a deviation between a property of fuel in the first supply path and a property of fuel in the second supply path, and iii) execute a unilateral injection process when the electronic control unit determines that there is a deviation between the property of fuel in the first supply path and the property of fuel in the second supply path, wherein the unilateral injection process is a process of causing fuel to be injected from one of the first injection valve and the second injection valve, and prohibiting fuel injection from the other injection valve.

2. The control system according to claim 1, wherein the electronic control unit is configured to execute the unilateral injection process when the electronic control unit determines that the engine is in idling operation and that there is a deviation between the property of fuel in the first supply path and the property of fuel in the second supply path.

3. The control system according to claim 1, wherein the electronic control unit is configured to execute the unilateral injection process when the electronic control unit determines that a vehicle is stopped and that there is a deviation between the property of fuel in the first supply path and the property of fuel in the second supply path.

4. The control system according to claim 1, wherein the electronic control unit is configured to i) determine that fuel stored in the fuel supply system before a change in the property of fuel in the fuel tank is old fuel, and that fuel in the fuel tank is new fuel, when there is a deviation between the property of fuel in the fuel tank and the property of fuel stored in the fuel supply system due to the change in the property of fuel in the fuel tank, and ii) cause fuel to be injected from a specific injection valve and prohibit fuel injection from the other injection valve, the other injection valve being one of the first injection valve and the second injection valve which is different from the specific injection valve, wherein the specific injection valve is one of the first injection valve and the second injection valve which injects fuel in a specific supply path, and the specific supply path is one of the first supply path and the second supply path in which the old fuel remains.

5. The control system according to claim 4, further comprising:

a detection sensor, wherein the detection sensor is provided in a common path and detects a property of fuel, the common path is connected to the fuel tank, upstream ends of both the first supply path and the second supply path are connected to a downstream end of the common path, and the electronic control unit is configured to determine whether there is a deviation between the property of fuel in the first supply path and the property of fuel in the second supply path when the property of fuel detected by the detection sensor changes.

6. The control system according to claim 4, wherein the electronic control unit is configured to calculate at least one of a first estimated value and a second estimated value, the first estimated value being an estimated value of an amount of the old fuel remaining in the first supply path that is estimated based on a volume of the first supply path and an amount of fuel injection from the first injection valve, and the second estimated value being an estimated value of an amount of the new fuel flowing into the first supply path, the electronic control unit is configured to calculate at least one of a third estimated value and a fourth estimated value, the third estimated value being an estimated value of an amount of old fuel remaining in the second supply path that is estimated based on a volume of the second supply path and an amount of fuel injection from the second injection valve, and the fourth estimated value being an estimated value of an amount of new fuel flowing into the second supply path, and the electronic control unit determines whether there is a deviation between the property of fuel in the first supply path and the property of fuel in the second supply path, based on a calculation result of one of the calculated first estimated value and the calculated second estimated value and a calculation result of one of the calculated third estimated value and the calculated fourth estimated value.

7. The control system according to claim 1, wherein the electronic control unit is configured to i) determine that fuel stored in the fuel supply system before an increase in an amount of fuel stored in the fuel tank is old fuel, and that fuel in the fuel tank is new fuel, when the amount of fuel stored in the fuel tank increases, and ii) cause fuel to be injected from a specific injection valve and prohibit fuel injection from the other injection valve, the other injection valve being one of the first injection valve and the second injection valve which is different from the specific injection valve, wherein the specific injection valve is one of the first injection valve and the second injection valve which injects fuel in a specific supply path, and the specific supply path is one of the first supply path and the second supply path in which the old fuel remains.

8. The control system according to claim 7, wherein the electronic control unit is configured to determine whether there is a deviation between the property of fuel in the first supply path and the property of fuel in the second supply path when the amount of fuel stored in the fuel tank increases.

9. The control system according to claim 7, wherein the electronic control unit is configured to calculate at least one of a first estimated value and a second estimated value, the first estimated value being an estimated value of an amount of old fuel remaining in the first supply path that is estimated based on a volume of the first supply path and an amount of fuel injection from the first injection valve, and the second estimated value being an estimated value of an amount of new fuel flowing into the first supply path, the electronic control unit is configured to calculate at least one of a third estimated value and a fourth estimated value, the third estimated value being an estimated value of an amount of old fuel remaining in the second supply path that is estimated based on a volume of the second supply path and an amount of fuel injection from the second injection valve, and the fourth estimated value being an estimated value of an amount of new fuel flowing into the second supply path, and the electronic control unit is configured to determine whether there is a deviation between the property of fuel in the first supply path and the property of fuel in the second supply path, based on a calculation result of one of the calculated first estimated value and the calculated second estimated value and a calculation result of one of the calculated third estimated value and the calculated fourth estimated value.

10. The control system according to claim 1, wherein the electronic control unit is configured to calculate an injection sharing ratio, the injection sharing ratio being a value obtained by dividing an amount of fuel injection from the first injection valve by a sum of the amount of fuel injection from the first injection valve and an amount of fuel injection from the second injection valve, and the electronic control unit is configured to determine that there is a deviation between the property of fuel in the first supply path and the property of fuel in the second supply path when an air-fuel ratio of exhaust gas flowing through an exhaust passage of the engine changes due to a change in the injection sharing ratio.

11. The control system according to claim 1, wherein fuel in the engine is alcohol-containing fuel, and the electronic control unit is configured to determine whether there is a deviation between a concentration of alcohol in fuel in the first supply path and a concentration of alcohol in fuel in the second supply path.

12. The control system according to claim 1, wherein the first injection valve is a valve that injects fuel into an intake passage, and the second injection valve is a valve that injects fuel into the cylinder.

* * * * *